US008619106B2

(12) United States Patent
Inokuma et al.

(10) Patent No.: US 8,619,106 B2
(45) Date of Patent: Dec. 31, 2013

(54) THERMAL HEAD AND THERMAL PRINTER INCLUDING THE SAME

(75) Inventors: Yoshihiro Inokuma, Kirishima (JP); Takahiro Shimozono, Okaya (JP); Yasuyuki Tanaka, Okaya (JP)

(73) Assignee: Kyocera Corporation, Kyoto-shi, Kyoto (JP)

( * ) Notice: Subject to any disclaimer, the term of this patent is extended or adjusted under 35 U.S.C. 154(b) by 42 days.

(21) Appl. No.: 13/404,463

(22) Filed: Feb. 24, 2012

(65) Prior Publication Data

US 2013/0057635 A1 Mar. 7, 2013

(30) Foreign Application Priority Data

Feb. 24, 2011 (JP) ..... 2011-038571

(51) Int. Cl.
*B41J 2/335* (2006.01)

(52) U.S. Cl.
USPC ..... 347/200; 347/203

(58) Field of Classification Search
USPC ..... 347/200–206
See application file for complete search history.

(56) References Cited

U.S. PATENT DOCUMENTS

| | | | | |
|---|---|---|---|---|
| 5,200,760 | A * | 4/1993 | Ujihara et al. | 347/201 |
| 6,256,053 | B1 | 7/2001 | Noshita | |
| 2006/0098052 | A1 | 5/2006 | Inokuma | |

FOREIGN PATENT DOCUMENTS

| | | | | |
|---|---|---|---|---|
| JP | 61-189955 | * | 8/1986 | 347/201 |
| JP | 2001260403 | A | 9/2001 | |

OTHER PUBLICATIONS

Machine-generated translation of JP 2001-260403, published on Sep. 2001.*

European Search Report, European Patent 2492102, Jul. 4, 2012, 3 pp.

* cited by examiner

*Primary Examiner* — Huan Tran
(74) *Attorney, Agent, or Firm* — Volpe and Koenig, P.C.

(57) ABSTRACT

A thermal head capable of dissipating heat accumulated in a heat accumulating layer efficiently and achieving clear printing, and a thermal printer including the thermal head are provided. A thermal head includes a substrate, a heat accumulating layer disposed on part of the substrate, a heat generating portion disposed on the heat accumulating layer, an electrode electrically connected to the heat generating portion, a protective layer that covers the heat generating portion and part of the electrode, and an insulating layer having thermal conductivity, the insulating layer covering part of a region of the electrode which region is not covered with the protective layer. The insulating layer covers part of the protective layer and extends over the heat accumulating layer.

15 Claims, 15 Drawing Sheets

THERMAL HEAD AND THERMAL PRINTER INCLUDING THE SAME

BACKGROUND OF THE INVENTION

1. Field of the Invention

The present invention relates to a thermal head and a thermal printer including the thermal head.

2. Description of the Related Art

In the related art, various thermal heads have been proposed as printing devices such as a facsimile or a video printer. For example, a thermal head disclosed in Japanese Unexamined Patent Publication JP-A 2001-260403 includes a substrate, a heat accumulating layer disposed on part of the substrate, a heat generating portion disposed on the heat accumulating layer, an electrode that supplies a current to the heat generating portion, a protective layer that covers the heat generating layer and part of the electrode. The heat accumulating layer has a function of accumulating heat generated from the heat generating portion to increase the temperature of the heat generating portion for a short time, up to a predetermined temperature for printing.

SUMMARY OF THE INVENTION

However, when the temperature of the heat generating portion after printing is maintained around a predetermined temperature increased for printing, even a region that is not supposed to be printed on a recording medium may be heated. As a result, an unexpected image is printed and it is difficult to achieve clear printing. This problem is particularly remarkable when printing is performed on a recording medium at a high speed.

A thermal head according to an embodiment of the invention includes a substrate; a heat accumulating layer disposed on part of the substrate; a heat generating portion disposed on the heat accumulating layer; an electrode electrically connected to the heat generating portion; a protective layer that covers the heat generating layer and part of the electrode; and an insulating layer having thermal conductivity, the insulating layer covering part of a region of the electrode which region is not covered with the protective layer. The insulating layer covers part of the protective layer and extends over the heat accumulating layer.

A thermal printer according to an embodiment of the invention includes the thermal head mentioned above; a conveying mechanism that conveys a recording medium onto the heat generating portion; and a platen roller that presses the recording medium against the heat generating portion.

According to the invention, it is possible to dissipate heat accumulated in a heat accumulating layer efficiently.

BRIEF DESCRIPTION OF THE DRAWINGS

Other and further objects, features, and advantages of the technology will be more explicit from the following detailed description taken with reference to the drawings wherein:

FIGS. 8A and 8B are views showing a relationship among the thermal head, an ink ribbon and a recording medium, in which FIG. 8A is a cross-sectional view taken along the line III-III of the thermal head shown in FIG. 7, and FIG. 8B is a cross-sectional view taken along the line IV-IV of the thermal head shown in FIG. 7;

FIGS. 9A and 9B are views showing a modified example of a relationship among the thermal head, the ink ribbon and the recording medium, in which FIG. 9A is a cross-sectional view corresponding to the cross-sectional view taken along the line III-III of the thermal head shown in FIG. 7, and FIG. 9B is a cross-sectional view corresponding to the cross-sectional view taken along the line IV-IV of the thermal head shown in FIG. 7.

FIGS. 11A and 11B are views showing a relationship among the thermal head, the ink ribbon and the recording medium, in which FIG. 11A is a cross-sectional view taken along the line VI-VI of the thermal head shown in FIG. 10B, and FIG. 11B is a cross-sectional view taken along the line VII-VII of the thermal head shown in FIG. 10B;

DETAILED DESCRIPTION

Figure 1:
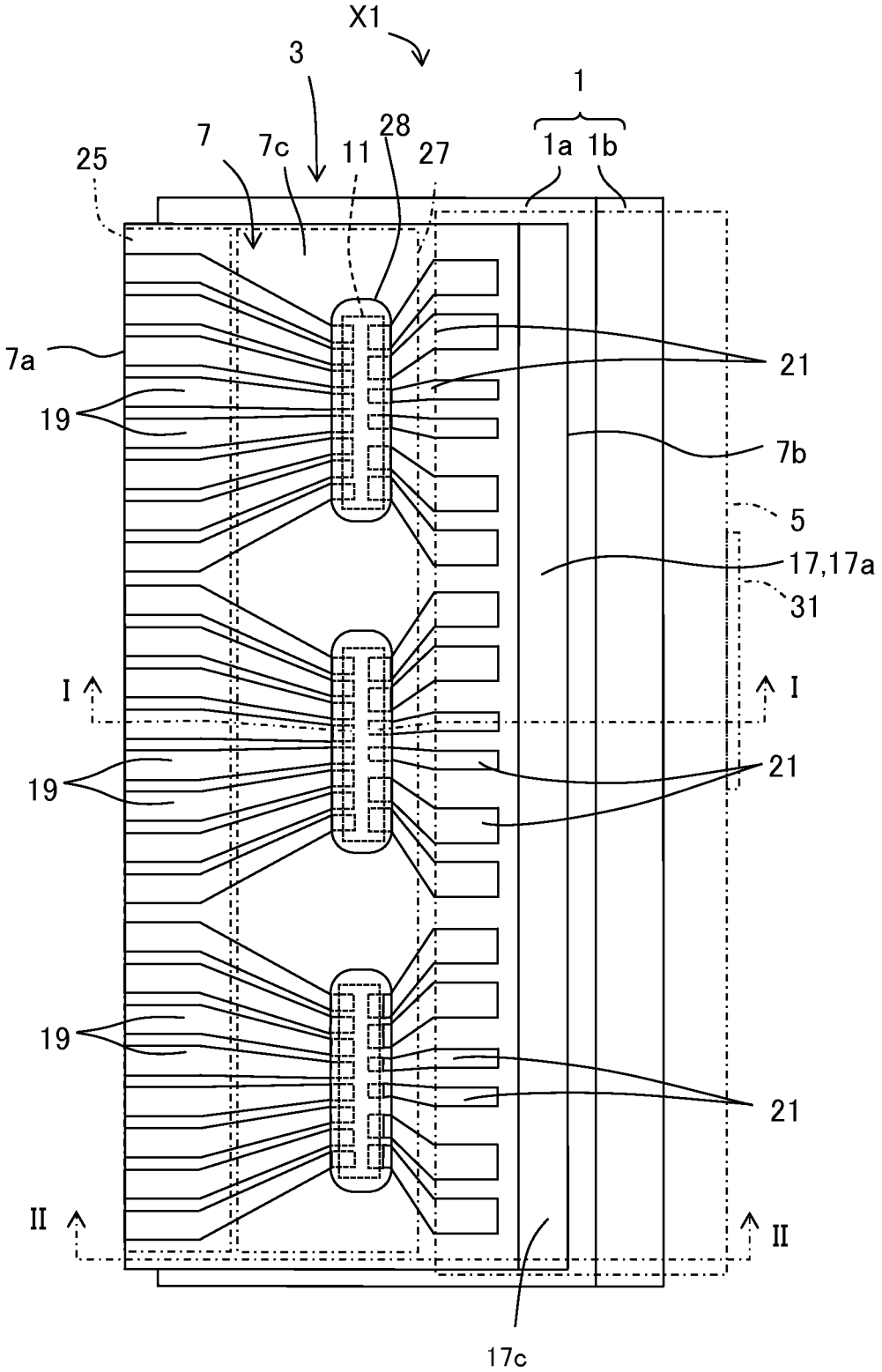
FIG. 1 is a plan view showing a thermal head according to a first embodiment of the invention.

Now referring to the drawings, preferred embodiments of the invention are described below.

<First Embodiment>

Hereinafter, a thermal head X1 according to a first embodiment of the invention is described with reference to the drawings. As shown in FIGS. 1, 2A, 2B, 3 and 4, a thermal head X1 includes a heat dissipating body 1, a head base substrate 3 disposed on the heat dissipating body 1, and a flexible printed circuit 5 (hereafter, referred to as FPC 5) connected to the head base substrate 3. In FIG. 1, the FPC 5 is not shown and a region where the FPC 5 is to be disposed is indicated by a two-dot chain line.

As shown in FIGS. 1, 2A, 2B, 3 and 4, the heat dissipating body 1 includes a plate-like bed 1*a* having a rectangular shape in a plan view and a protrusion lb disposed on an upper face of the bed 1*a* and extending along one of long sides of the bed 1*a*. The heat dissipating body 1 is made of a metal material such as copper or aluminum, and has a function of dissipating part of heat that does not contribute to printing, of the heat generated by the heat generating portions 9 of the head base substrate 3, as described below.

Figure 2A:
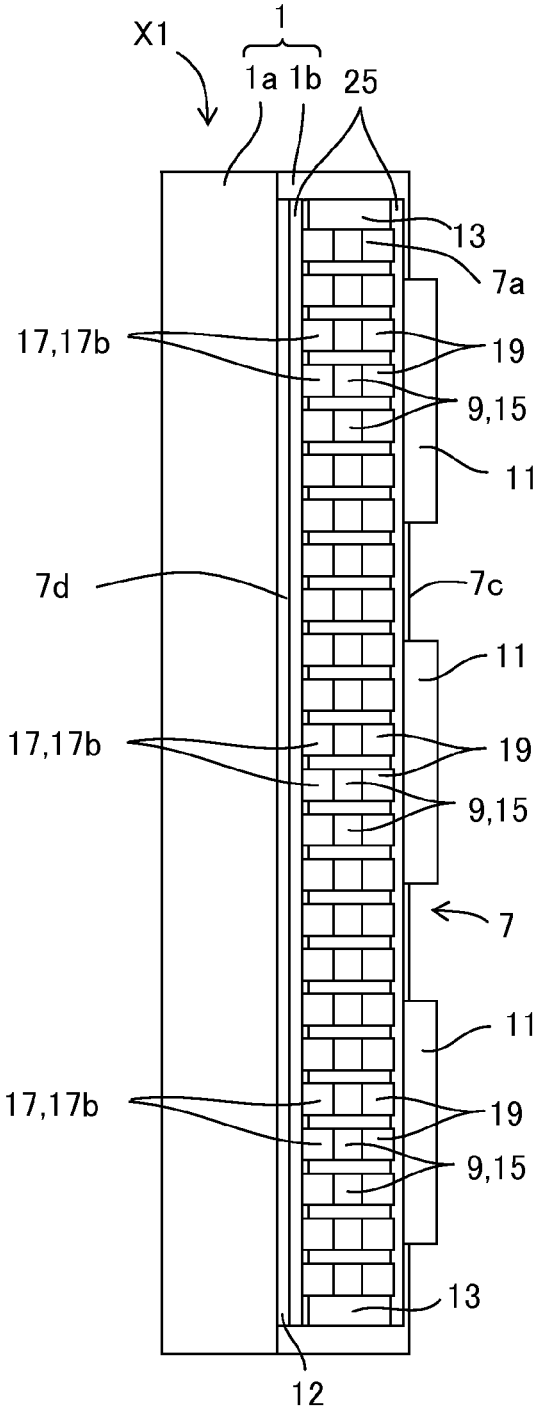
FIG. 2A is a left side view of the thermal head shown in FIG. 1
Figure 2B:
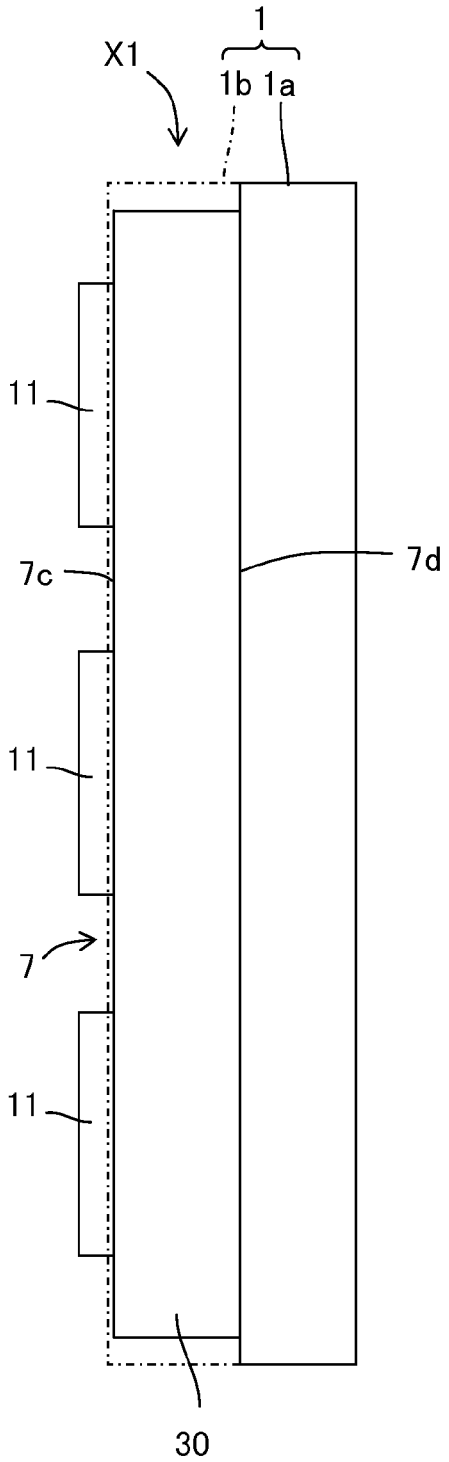
FIG. 2B is a right side view of the thermal head shown in FIG. 1, in which a protective layer and a second insulating layer on a heat accumulating layer are not shown.

As shown in FIGS. 1, 2A and 2B, the head base substrate 3 includes a substrate 7, a plurality of heat generating portions 9 disposed on the substrate 7, and a plurality of driving ICs 11 that control driving of the heat generating portions 9. The substrate 7 has a rectangular shape in a plan view. The substrate 7 includes a first end face 7*a*, a second end face 7*b*, a first main face 7*c* and a second main face 7*d*. The first end face 7*a* is a face adjacent to the first main face 7*c* and the second main face 7*d*. The second end face 7*b* is a face disposed opposite to the first end face 7*a*. The first main face 7*c* is a face adjacent to the first end face 7*a* and the second end face 7*b*. The second main face 7*d* is a face disposed opposite to the first main face 7*c*. The heat generating portions 9 are arranged on the first end face 7*a* in a line along a longitudinal direction of the substrate 7. The plurality of driving ICs 11 is disposed on the first main face 7*c* of the substrate 7.

The head base substrate 3, as shown in FIGS. 1, 2A, 2B, 3 and 4, is disposed on an upper face of the bed 1*a* of the heat dissipating body 1 and disposed so that the second end face 7*b* is opposite to the protrusion lb of the heat dissipating body 1. Further, the second main face 7*d* of the head base substrate 3 and the upper face of the bed la are bonded by a bonding layer 12 implemented by a double-sided tape or an adhesive. Here, the bonding layer 12 has thermal conductivity. Thus, the head base substrate 3 is supported by the bed 1*a*. Consequently, the second main face 7*d* is located downstream in a conveyance direction of a recording medium to be recorded such as paper, thermal paper or a card.

The substrate 7 is made of an electric insulating material such as alumina ceramics or a semiconductor material such as monocrystal silicon. Although the substrate 7 has a rectangular shape in a plan view, even if the corners of the substrate 7 are chamfered, this is included in a substrate having a rectangular shape in a plan view.

Figure 3:
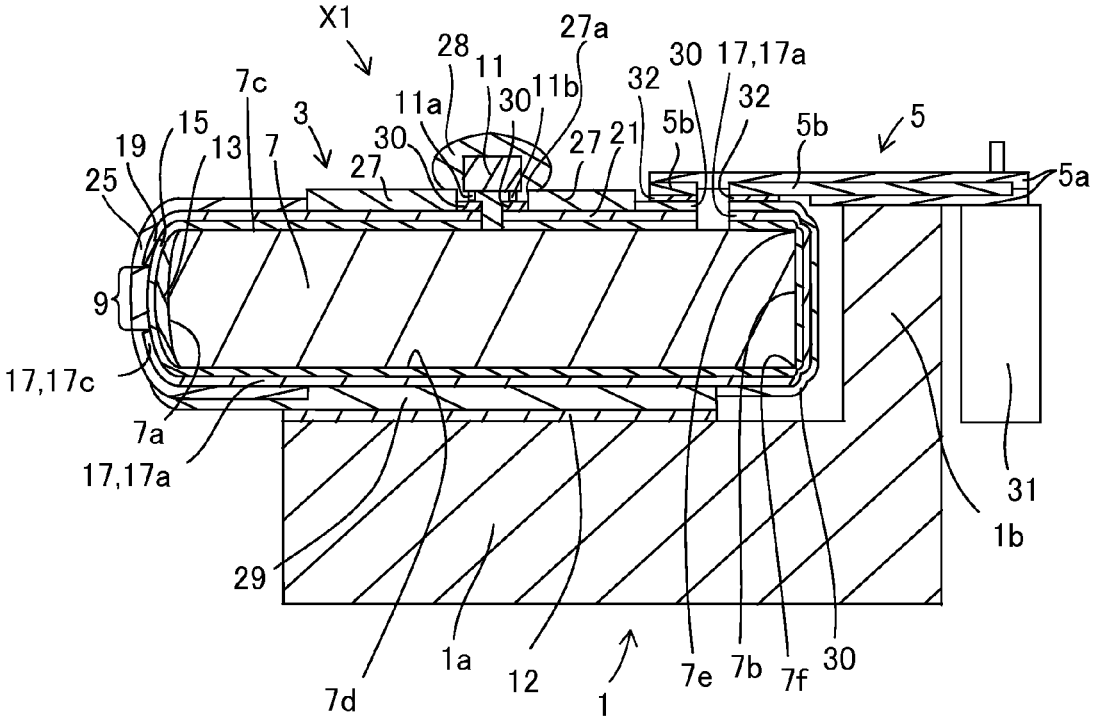
FIG. 3 is a cross-sectional view taken along the line I-I of the thermal head shown in FIG. 1.
Figure 4:
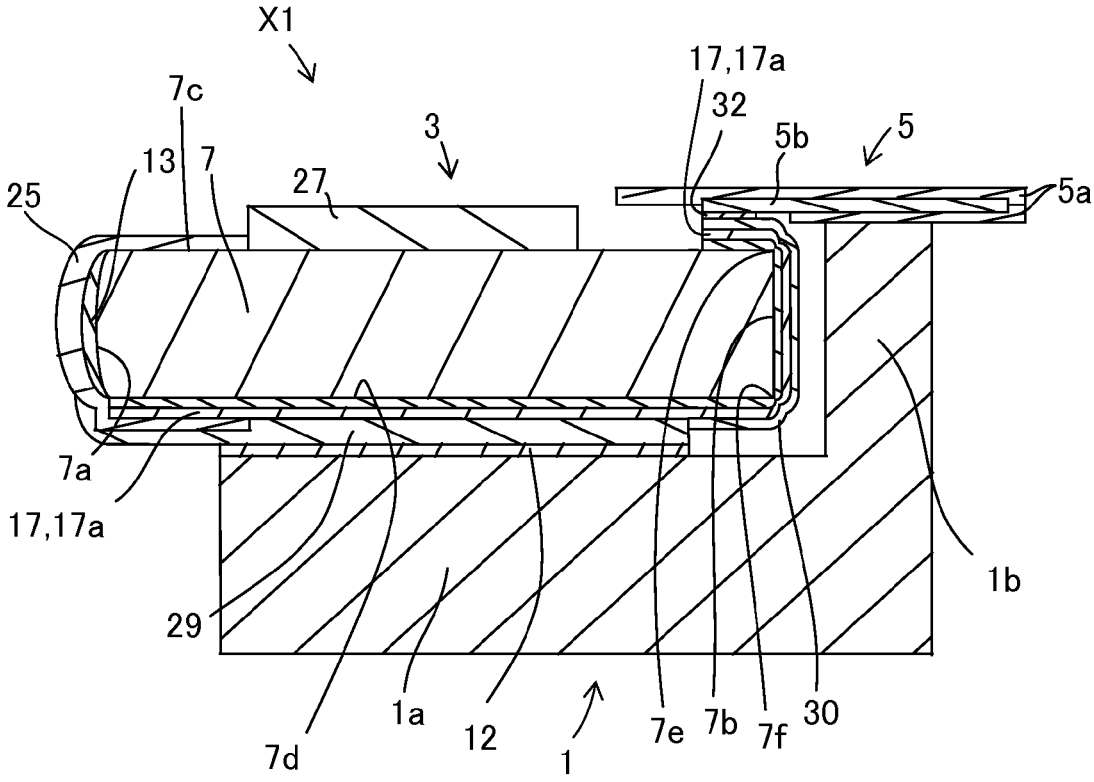
FIG. 4 is a cross-sectional view taken along the line II-II of the thermal head shown in FIG. 1.

As shown in FIGS. 3 and 4, a heat accumulating layer 13 is formed on the first end face 7*a* of the substrate 7. The first end face 7*a* of the substrate 7 has a curved face with a protruding cross-sectional shape, and the heat accumulating layer 13 is formed on the first end face 7*a. Thus, the face of the heat accumulating layer* 13 *is curved. The heat accumulating layer* 13 *having the curved face functions to appropriately press a recording medium to be printed, against a protective layer* 25 *formed on the heat generating portions* 9, *which is described below.*

The heat accumulating layer 13, for example, is made of glass, and temporarily accumulates some of the heat generated by the heat generating portions 9. Here, it is preferable that the glass preferably has low thermal conductivity. Thus, it is possible to reduce the time for increasing the temperature of the heat generating portions 9 and increase thermal responsiveness of the thermal head X1. Further, in the embodiment, as shown in FIG. 3, the heat accumulating layer 13 is formed only on the first end face 7*a* of the substrate 7 and can accumulate heat around the heat generating portions 9. Thus, it is possible to more effectively increase the thermal responsiveness of the thermal head X1. Here, the heat accumulating layer 13 is formed, for example, by applying a glass paste obtained by mixing an appropriate organic solvent to glass powder, onto the first end face 7*a* of the substrate 7 by screen printing or the like, which is known in the art, and then firing it.

As shown in FIGS. 3 and 4, an electric-resistive layer 15 is disposed on the first main face 7*c* of the substrate 7, the heat accumulating layer 13, and the second main face 7*d* and the second end face 7*b* of the substrate 7. The electric-resistive layer 15 is disposed between the substrate 7 and the heat accumulating layer 13, and a common electrode 17, an individual electrode 19 and an IC-FPC connection electrode 21, which are described below.

A region of the electric-resistive layer 15 located on the first main face 7*c* of the substrate 7 is formed in the same shape as the common electrode 17, the individual electrode 19, and the IC-FPC connection electrode 21, in a plan view, as shown in FIG. 1.

A region of the electric-resistive layer 15 on the heat accumulating layer 13 has a region formed in the same shape as the common electrode 17 and the individual electrode 19, in a side view, as shown in FIGS. 2A and 2B, and a plurality of exposed regions of exposed from between the common electrode 17 and the individual electrode 19.

A region of the electric-resistive layer 15 on the second main face 7*d* of the substrate 7, though not shown in detail, as shown in FIGS. 3 and 4, is disposed throughout the second main face 7*d* of the substrate 7, and formed in the same shape as the common electrode 17.

A region of the electric-resistive layer 15 on the second end face 7*b* of the substrate 7, though not shown in detail, as shown in FIGS. 3 and 4, is disposed throughout the second end face 7*b* of the substrate 7, and formed in the same shape as the common electrode 17.

Since the regions of the electric-resistive layer 15 are formed, as described above, the electric-resistive layer 15 is covered by the common electrode 17, the individual electrode 19, and the IC-FPC connection electrode 21 in FIG. 1, such that it is not shown. Further, in FIGS. 2A and 2B, the electric-resistive layer 15 is covered by the common electrode 17 and the individual electrode 19, such that only the exposed regions are shown.

The exposed regions of the electric-resistive layer 15 form the heat generating portions 9. Further, the exposed regions, as shown in FIGS. 2A and 2B, are arranged in a line on the heat accumulating layer 13. The heat generating portions 9 are schematically shown in FIGS. 2A and 2B, but, for example, are disposed with density of 180 dpi to 2400 dpi (dot per inch). Further, as shown in FIGS. 2A and 2B, the heat generating portions 9 are disposed substantially at the middle portion in a thickness direction of the substrate 7, on the heat accumulating layer 13. Hereafter, a region of the heat accumulating layer 13 where the heat generating portions 9 are formed is referred to as a first region of the heat accumulating region 13.

The electric-resistive layer 15 is made of, for example, a material having relatively high electric resistance, such as a TaN-based, TaSiO-based, TaSiNO-based, TiSiO-based, TiSiCO-based, or NbSiO-based material. Therefore, when a voltage is applied across the common electrode 17 and the individual electrode 19, which are described below, and a current is supplied to the heat generating portions 9, the heat generating portions 9 generates heat by joule heat generation.

As shown in FIGS. 1, 2A, 2B, 3 and 4, the common electrode 17, a plurality of individual electrodes 19, and a plurality of IC-FPC connection electrodes 21 are disposed on the electric-resistive layer 15. The common electrode 17, the individual electrodes 19, and the IC-FPC connection electrodes 21 are made of a conductive material, and for example, made of one metal of aluminum, gold, silver and copper, or an alloy of them.

The individual electrodes 19 connect the heat generating portions 9 with the driving ICs 11. As shown in FIGS. 1, 2A, 2B and 3, the individual electrodes 19 are each connected with the heat generating portions 9 at one end thereof and separately extend in a strip on the first main face 7*c* of the substrate 7 from the first end face 7*a* of the substrate 7.

The other ends of the individual electrodes 19 are disposed in regions where the driving ICs 11 are disposed, and the other ends of the individual electrodes 19 are connected to the driving Ics 11. Therefore, electrical connection between the respective heat generating portions 9 and the driving ICs 11 is established. In detail, the individual electrodes 19 divide the heat generating portions 9 in a plurality of groups and electrically connect each group of the heat generating portions 9 to the driving ICs 11 disposed corresponding to each group.

The IC-FPC connection electrodes 21 connect the driving ICs 11 with the FPC 5. As shown in FIGS. 1 and 3, each of the IC-FPC connection electrodes 21 extends in a strip on the first main face 7*c* of the substrate 7 and one end thereof is disposed in the region where the driving IC 11 is disposed. The other end thereof each of the IC-FPC electrodes 21 is disposed around a main wire portion 17*a* of the common electrode 17 disposed on the second end face 7*b* side on the first main face 7*c* of the substrate 7. Further, the IC-FPC connection electrodes 21 each has one end electrically connected to the driving IC 11 and the other end electrically connected to the FPC 5, whereby electrically connecting the driving ICs 11 and the FPC 5.

In detail, the IC-FPC connection electrodes 21 connected to the driving ICs 11 are constituted by a plurality of electrodes having different functions. Examples of the IC-FPC connection electrodes 21 include a power supply electrode (not shown), a ground electrode (not shown) and an IC control electrode (not shown). The power supply electrode has a function of driving the driving IC 11 and applying a voltage for driving the thermal head X1. The ground electrode has a function of maintaining the driving ICs 11 and the individual electrodes 19 connected to the driving ICs 11 at a ground potential of 0 V to 1 V. The IC control electrode has a function of supplying a signal for controlling an on/off state of a switch element in the driving IC 11.

The driving ICs 11, as shown in FIG. 1, are disposed corresponding to each group of the heat generating portions 9. The driving IC 11 is connected to the other end of the individual electrode 19 and one end of the IC-FPC connection electrode 21. The driving ICs 11 are provided for controlling the electric conduction of the heat generating portions 9, and control heat generation driving of the heat generating portions 9 by switching a plurality of switching elements (not shown) provided therein.

The driving ICs 11 each has a plurality of switching elements therein to correspond to each of the individual electrodes 19 connected to the driving ICs 11, respectively. As shown in FIG. 3, in the driving IC 11, one connection terminal 11*a* (hereafter, referred to as a first connection terminal 11*a*) connected to the switching element is connected to the individual electrode 19. The other connection terminal 11*b* (hereafter referred to as a second connection terminal 11*b*) connected to the switching element is connected to the IC-FPC connection electrode 21. In detail, the first connection terminal 11*a* and the second connection terminal 11*b* of the driving IC 11 are solder-bonded to a coating layer 30, which is described below, formed on the individual electrode 19 and the IC-FPC connection electrode 21 by a solder (not shown). Accordingly, when the switching element of the driving IC 11 is in an on-state, the individual electrode 19 and the IC-FPC connection electrode 21, which are connected to the switching element, are electrically connected.

The driving ICs 11 are sealed by being coated with a coating member 28 made of resin such as epoxy resin or silicone resin, in a state where the driving ICs 11 are connected to the individual electrodes 19 and the IC-FPC connection electrodes 21. Accordingly, it is possible to protect the driving ICs 11 themselves and the connecting portions between the driving ICs 11 and wires therefor.

The common electrode 17 connects the heat generating portions 9 with the FPC 5. The common electrode 17 has the main wire portion 17*a* and a lead portion 17*c*. As shown in FIGS. 1, 3, and 4, the main wire portion 17*a* is formed throughout the second main face 17*d* and the second end face 7*b* of the substrate 7 and formed to extend along the second end face 7*b* on the substrate 7 on the first main face 7*c*. The lead portion 17*c* is formed on the first end face 7*a* of the substrate 7, and one end thereof electrically connects the main wire portion 17*a* disposed on the second main face 7*d* of the substrate 7 and the heat generating portion 9. Further, the lead portion 17*c* is disposed so that one end thereof is opposite to the individual electrode 19, and is connected to the heat generating portion 9.

Accordingly, the common electrode 17 is disposed so that one end thereof is opposite to one end of the individual electrode 19, and is connected to the heat generating portion 9. Further, the common electrode 17 extend over the first main face 7*c* of the substrate 7 through the second main face 7*d* of the substrate 7 and the second end face 7*b* of the substrate 7, from the first end face 7*a* of the substrate 7.

A method of forming the electric-resistive layer 15, the common electrode 17, the individual electrode 19 and the IC-FPC connection electrode 21 is exemplified. Materials forming the layer and the electrodes are sequentially laminated on the substrate 7 where the heat accumulating layer 13 is formed by a thin-film formation technique known in the art such as sputtering. Then, the laminated body is processed in a predetermined pattern by using photo-etching, which is kwon in the art. Thus, it is possible to form them. Further, the thickness of the electric-resistive layer 15 may be, for example, 0.01 μm to 0.2 μm, and the thicknesses of the common electrode 17, the individual electrode 19, and the IC-FPC connection electrode 21 may be, for example 0.05 μm to 2.5 μm. Here, the thickness of the common electrode 17 on the first main face 17*c* and the thickness of the common electrode 17 on the second main face 7*d* may be different, and their thicknesses may be different according to parts of the electrode.

As shown in FIGS. 1, 2A, 2B, 3 and 4, a protective layer 25 is disposed to cover the heat generation portions 9, part of the common electrodes 17, and part of the individual electrodes 19 on the heat accumulating layer 13 and the first main face 7*c* and the second main face 7*d* of the substrate 7. The protective layer 25, as shown in FIGS. 1, 3, and 4, is disposed to cover the left region on the first main face 7*c* of the substrate 7. The protective layer 25 is disposed to cover the entire region on the heat accumulating layer 13. The protective layer 25 is disposed to cover the left region on the second main face 7*d* of the substrate 7, the same as the first main face 7*c* of the substrate 7. Accordingly, the protective layer 25 is formed over a region from the first end face 7*a* of the substrate 7 to the first main face 7*c* of the substrate 7, and is formed over a region from the first end face 7*a* of the substrate 7 and to the second main face 7*d* of the substrate 7. Further, for the convenience of description, in FIG. 1, the regions where the protective layer 25 is formed are indicated by a dashed line and not shown in the figure.

The protective layer 25 has a function of protecting the region covering the heat generating portions 9, the part of the common electrodes 17, and the part of the individual electrodes 19 from corrosion due to the moisture in the atmosphere which adheres thereto or wear due to contact with the recording medium to be printed. The protective layer 25 may be made of, for example, a material such as SiC-based, SiN-based, SiO-based, or SiON-based material. Here, the protective layer 25 may contain a small amount of another element such as Al or Ti.

Further, the protective layer 25, for example, may be formed by a thin-film formation technique known in the art such as sputtering or vapor deposition, or a thick-film formation technique such as screen printing. The thickness of the protective layer 25, for example, may be 3 μm to 12 μm. The protective layer 25 may be formed by laminating a plurality of material layers.

Further, the protective layer 25 has heat conductivity, in addition to the function of suppressing corrosion or wear of the common electrodes 17 and the individual electrodes 19, as described above. Therefore, the heat generated by the heat generating portions 9 efficiently transfers to the recording medium to be printed.

Further, as shown in FIGS. 1, 3, and 4, a first insulating layer 27 partially covering the individual electrodes 19 and the IC-FPC connection electrodes 21 is disposed on the first main face 7*c* of the substrate 7. The first insulating layer 27, as shown in FIG. 1, is disposed to partially cover the right region from the protective layer 25 on the first main face 7*c* of the substrate 7. Further, for the convenience of description, in FIG. 1, the region where the first insulating layer 27 is formed is indicated by a dashed line and not shown in the figure.

The first insulating layer 27 has a function of protecting coated regions of the individual electrodes 19 and the IC-FPC connection electrodes 21 from oxidation due to contact with the atmosphere and corrosion due to the moisture in the atmosphere which adheres thereto. The first insulating layer 27, for example, may be made of a resin material such as epoxy resin or polyimide resin. Further, the first insulating layer 27, for example, may be formed by a thick-film formation technique such as screen printing. Further, the first insulating layer 27 has electric insulation, and has such a configuration that short-circuiting between adjacent individual electrodes 19 is avoided even though covering the individual electrodes 19, as described above.

Further, as shown in FIGS. 1 and 3, the end of the IC-FPC connection electrode 21 connecting the FPC 5, which is described below, is exposed from the first insulating layer 27 and therefore it is possible to connect the FPC 5.

Further, openings 27*a* (see FIG. 3) configured to expose the ends of the individual electrode 19 and the IC-FPC connection electrode 21 which connect the driving ICs 11 are formed in the first insulating layer 27. The individual electrode 19 and the IC-FPC connection electrode 21 are connected to the driving ICs 11 through the openings 27*a*. In the embodiment, a coating layer 30 described below is formed on the ends of the individual electrode 19 and the IC-FPC connection electrode 21, which are exposed from the openings 27*a*. Further, the individual electrode 19 and the IC-FPC connection electrode 21 are solder-bonded to the driving ICs 11 through the coating layer 30. As described above, by solder-bonding the driving ICs 11 to the coating layer 30 formed by plating, the strength of connecting the driving ICs 11 onto the individual electrodes 19 and the IC-FPC connection electrodes 21 can be improved.

As shown in FIGS. 3 and 4, a second insulating layer 29 partially covering the common electrodes 17 on the second main face 7*d* of the substrate 7 is formed on the second main face 7*d* of the substrate 7. The second insulating layer 29 is disposed to extend in the longitudinal direction of the substrate 7 while covering substantially the entire region on the second main face 7*d* of the substrate 7. In detail, the second insulating layer 29 is disposed to extending from the second end face 7*b* side of the second main face 7*d* to the protective layer 25 on the first end face 7*a* side of the second main face 7*d* of the substrate 7. Further, the second insulating layer 29 is formed to cover the region of the common electrodes 17 at the right side from the protective layer 25 on the second main face 7*d* of the substrate 7. Here, in the embodiment, the second insulating layer 29 corresponds to an insulating layer of the invention. The second insulating layer 29 has a function of protecting coated region of the common electrodes 17 from oxidation due to contact with the atmosphere or corrosion due to the moisture in the atmosphere which adheres thereto, by covering the common electrodes 17. The second insulating layer 29, similar to the first insulating layer 27, for example, may be made of a resin material such as epoxy resin or polyimide resin. Further, the second insulating layer 29, for example, may be formed by a thick-film formation technique such as screen printing. The thickness of the second insulating layer 29 may be, for example, 20 μm to 60 μm.

As shown in FIGS. 3 and 4, the second insulating layer 29 further extends from the second main face 7*d* of the substrate 7 to the heat accumulating layer 13. Further, the end of the second insulating layer 29 on the heat accumulating layer 13 is located on the protective layer 25 located on a region of the heat accumulating layer 13 which is closer to the second main face 7*d* of the substrate 7 than the first region of the accumulating layer 13 (hereafter, referred to as a second region). Here, in the embodiment, the fact that the end of the second insulating layer 29 on the heat accumulating layer 13 is located on the protective layer 25 located on the second region of the heat accumulating layer 13 means that the end of the second insulating layer 29 is located in a region opposite the surface of the second region of the heat accumulating layer 13.

Thus, in the thermal head X1 of the embodiment, the second insulating layer 29 having thermal conductivity extends from the second main face 7*d* of the substrate 7 to the heat accumulating layer 13. Further, the end of the second insulating layer 29 on the heat accumulating layer 13 is located on the protective layer 25 located on the second region of the heat accumulating layer 13 which is closer to the second main face 7*d* of the substrate 7 than the first region of the heat accumulating layer 13. Therefore, the heat accumulated in the second region of the heat accumulating layer 13 easily transfers to the second insulating layer 29 on the protective layer 25, in addition to the protective layer 25 on the second region of the heat accumulating layer 13. Further, since the second insulating layer 29 on the second main face 7*d* of the substrate 7 is bonded to the heat dissipating body 1, the heat transferring to the second insulating layer 29 from the second region of the heat accumulating layer 13 easily transfers to the heat dissipating body 1.

Therefore, according to the thermal head X1 of the embodiment, it is possible to improve the performance of dissipating the heat accumulated in the heat accumulating layer 13, such that it is possible to perform clear printing.

In detail, the heat accumulated in the heat accumulating layer 13 is transferred to the second insulating layer 29 through the substrate 7, the electric-resistive layer 15, the common electrode 17 and the protective layer 25. Further, the heat having transferred the second insulating layer 29 is transferred to the heat dissipating body 1 through the bonding layer 12 to be dissipated externally.

In particular, in the thermal head X1, since the second insulating layer 29 is formed so as to extend to the second region of the heat accumulating layer 13, it is possible to efficiently dissipate the heat transferred to the protective layer 25 on the second region of the heat accumulating layer 13, through the second insulating layer 29.

Further, in the thermal head X1, since the second insulating layer 29 having thermal conductivity extends from the second main face 7*d* of the substrate 7 to the heat accumulating layer 13 and the second main face 7*d* is disposed downstream in the conveyance direction of the recording medium, it is possible to reduce accumulation of paper scraps, dust or the like in the second region at the downstream in the conveyance direction of the recording medium.

Figure 5:
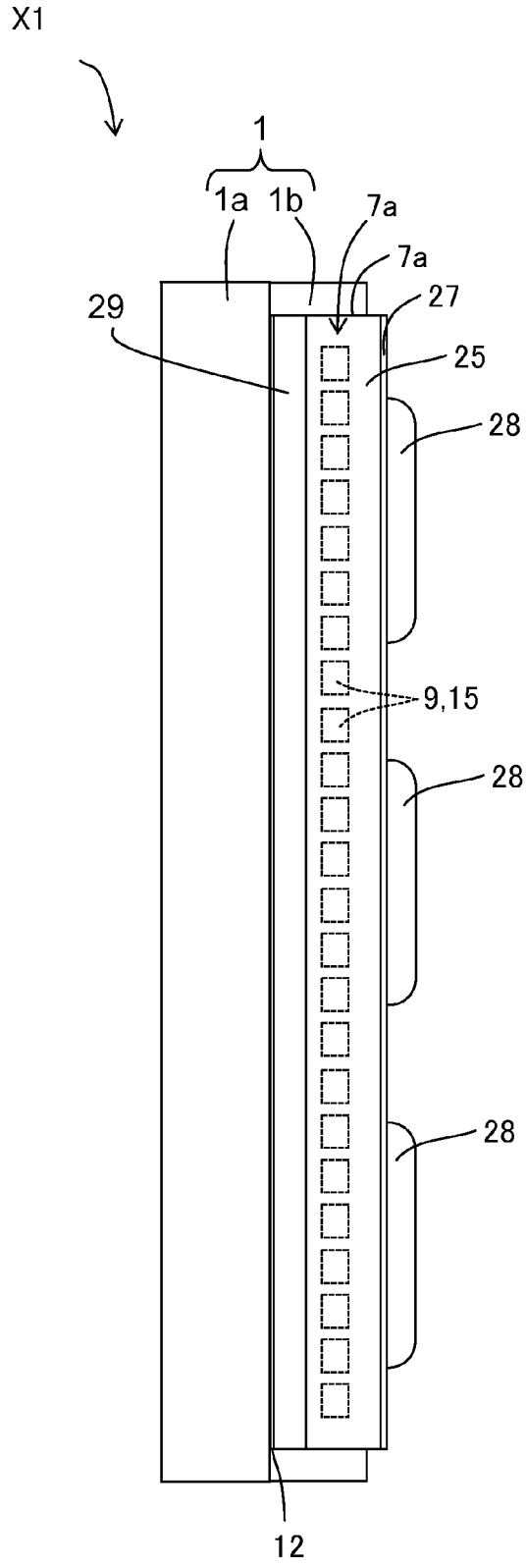
FIG. 5 is a left side view of the thermal head shown in FIG. 1.

Further, as shown in FIG. 5, the second insulating layer 29 on the heat accumulating layer 13 extends throughout in the longitudinal direction of the substrate 7 from an end view, and the shape of the end of the second insulating layer 29 on the heat accumulating layer 13 is straight. Here, the language "viewing the end face" means viewing the first end face 7*a*.

Further, the second insulating layer 29, as described above, has heat conductivity, in addition to the function of suppressing oxidation or corrosion of the common electrodes 17. Therefore, as described above, as the end of the second insulating layer 29 is located on the second region of the heat accumulating layer 13, the heat accumulated in the heat accumulating layer 13 easily transfers to the second insulating layer 29, in addition to the protective layer 25.

As shown in FIGS. 3 and 4, the second insulating layer 29 formed on the second main face 7*d* of the substrate 7 is bonded to the bed 1*a* of the heat dissipating body 1 by the bonding layer 12. Therefore, as described above, the head base substrate 3 is supported by the bed 1*a* of the heat dissipating body 1. Further, since the second insulating layer 29 is bonded to the heat dissipating body 1, the heat transferred to the second insulating layer 29 from the heat accumulating layer 13 easily transfers to the heat dissipating body 1.

Here, as shown in FIGS. 3 and 4, a region around the second end face 7*b* of the common electrode 17 located on the second main face 7*d* of the substrate 7 is not covered with the second insulating layer 29, and as described below, covered with the coating layer 30.

As shown in FIGS. 3 and 4, regions of the common electrodes 17 located on a corner 7*e* formed by the first main face 7*c* and the second end face 7*b* of the substrate 7 and on a corner 7*e* formed by the second main face 7*d* and the second end face 7*b* of the substrate 7 are covered with the coating layer 30 formed by plating. In detail, in the embodiment, the coating layer 30 continuously covers the entire region of the common electrodes 17 located on the first main face 7*c* and the second end face 7*b* of the substrate 7, the entire region of the common electrodes 17 located on the second main face 7*d* of the substrate 7, and a region of the common electrodes 17 located the corner 7*f* formed by the second main face 7*d* and the second end face 7*b* of the substrate 7.

The coating layer 30 may be made of metal or alloy, and, for example, may be formed by electroless plating or electrolytic plating, which is known in the art. Further, as the coating layer 30, a first coating layer formed by nickel-plating may be formed on the common electrode 17, and then a second coating layer formed by gold-plating may be formed on the first coating layer. In this case, the thickness of the first coating layer may be, for example, 1.5 μm to 4 μm, and the thickness of the second coating layer may be, for example, 0.02 μm to 0.1 μm.

Further, in the embodiment, as shown in FIG. 3, the coating layer 30 formed by plating is also formed on the ends of the IC-FPC connection electrodes 21 connecting the FPC 5 described below. Accordingly, as described below, the FPC 5 is connected onto the coating layer 30.

Further, in the embodiment, as shown in FIG. 3, the coating layer 30 formed by plating is also formed on the ends of the individual electrodes 19 and the IC-FPC connection electrodes 21 that are exposed from the openings 27*a* of the first insulating layer 27. Therefore, as described above, the driving ICs 11 are connected to the individual electrodes 19 and the IC-FPC connection electrodes 21 through the coating layer 30.

The FPC 5, as shown in FIGS. 1, 3, and 4, is connected to the main wire portions 17*a* of the common electrodes 17 and the IC-FPC connection electrodes 21 that extend in the longitudinal direction of the substrate 7 and are located on the first main face 7*c* of the substrate 7, as described above. The FPC 5 is one known in the art including a plurality of print wires disposed in an insulating resin layer, and the print wires are electrically connected to external power supply and control device, which are not shown, through a connector 31. The print wires, for example, are formed by a metal foil such as a copper foil, a conductive thin film formed by a thin-film formation technique, or a conductive thick film formed by a thick-film printing technique. Further, the print wires formed by a metal foil or a conductive thin film, for example, are patterned by partially etching the print wires by photo-etching.

In detail, as shown in FIGS. 3 and 4, in the FPC 5, the print wires 5*b* formed in the insulating resin layer 5*a* are exposed at the resin layer 5*a* of the second end face 7*b* side, and bonded by a joint material 32. Examples of the joint material includes a conductive joint material, a solder material or an anisotropic conductive material (ACF) obtained by mixing conductive particles in electric insulating resin. Further, the print wires 5*b* of the FPC 5 are connected to the ends of the main wire portions 17*a* of the common electrodes 17 located on the first main face 7*c* of the substrate 7 and the ends of the IC-FPC connection electrodes 21.

Further, in the embodiment, since the coating layer 30 is formed on the common electrodes 17 located on the first main face 7*c* of the substrate 7, as described above, the print wires 5*b* connected to the common electrodes 17 are connected to the coating layer 30 through the joint material 32. Further, in the embodiment, since the coating layer 30 is also formed on the ends of the IC-FPC connection electrodes 21, the print wires 5*b* connected to the IC-FPC connection electrodes 21 are also connected to the coating layer 30 through the joint material 32. As described above, as the print wires 5*b* are connected onto the coating layer 30 formed by plating, the strength of connecting the print wires 5*b* to the common electrodes 17 and the IC-FPC connection electrodes 21 can be improved.

Further, the print wires 5*b* of the FPC 5 are electrically connected to external power supply or control device, which are not shown, through the connector 31. In this time, the common electrodes 17 are electrically connected to the positive terminal of a power supply maintained at a positive potential of, for example, 20 V to 24 V. Further, the individual electrodes 19 are electrically connected to the negative terminal of the power supply maintained at a ground potential of, for example, 0 V to 1 V through the driving ICs 11 and the ground electrodes of the IC-FPC connection electrodes 21. Therefore, when the switching elements of the driving ICs 11 are in an on-state, a voltage is applied to the heat generating portions 9 and the heat generating portions 9 generate heat.

Further, similarly, the IC power electrodes of the IC-FPC connection electrodes 21, similar to the common electrodes 17, are electrically connected to the positive terminal of the power supply maintained at a positive potential. Therefore, a power current for operating the driving ICs 11 is supplied to the driving ICs 11 by the potential difference between the ground electrodes and the IC power electrodes of the IC-FPC connection electrodes 21 where the driving ICs 11 are connected. Further, the IC control electrodes of the IC-FPC connection electrodes 21 are electrically connected to an external control device that controls the driving ICs 11. Therefore, an electric signal received sent from the control device is supplied to the driving ICs 11. By operating the driving ICs 11 such that on/off state of the switching element in the driving ICs 11 are controlled by the electric signal, it is possible to make the heat generating portions 9 selectively generate heat.

Further, the FPC 5 is bonded to the upper surface of the protrusion lb of the heat dissipating body 1 by a double-sided tape or an adhesive (not shown), for example a resin, and is thereby fixed to the heat dissipating body 1.

Figure 6:
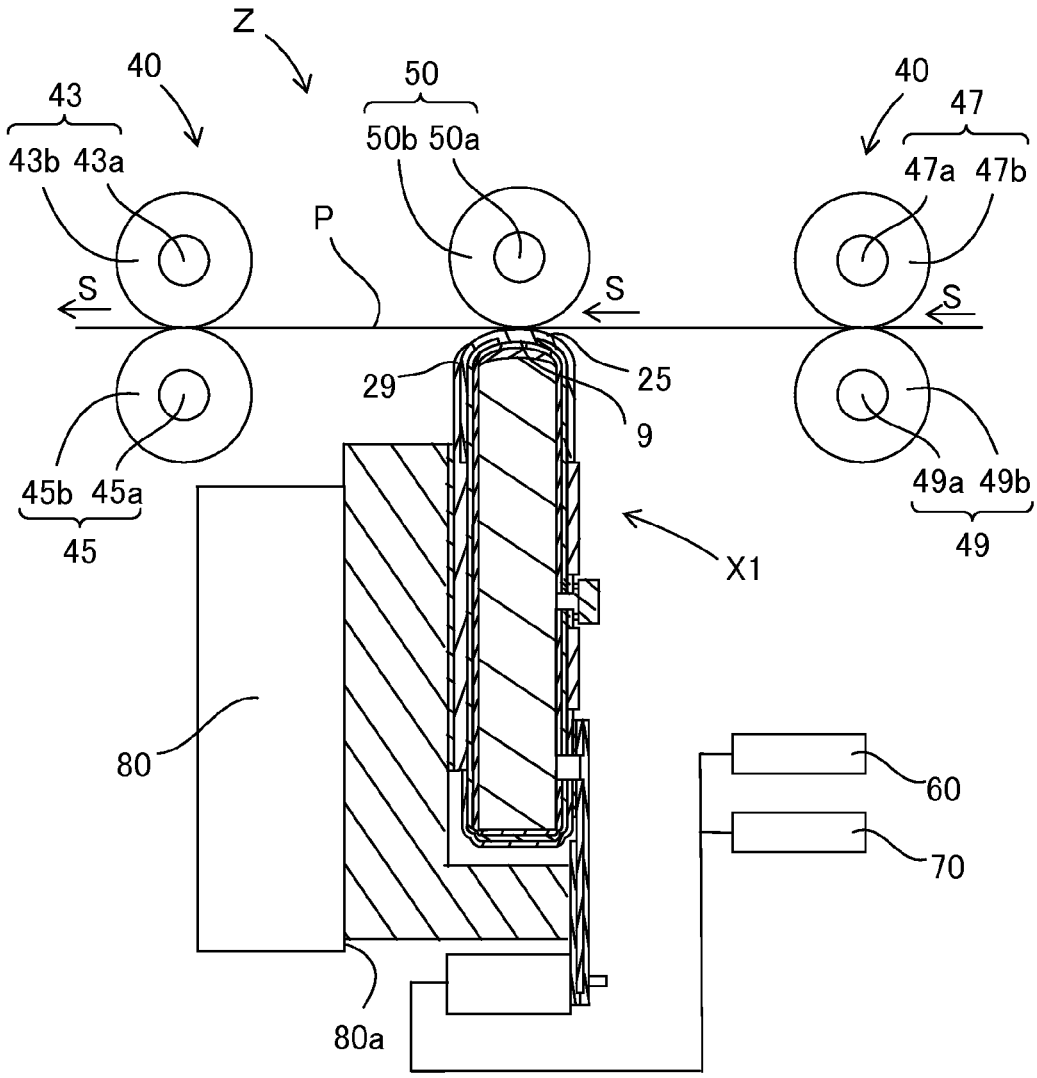
FIG. 6 is a view showing a schematic configuration of a thermal printer according to an embodiment of the invention.

Next, an embodiment of a thermal printer of the invention is described with reference to FIG. 6. FIG. 6 is a view showing a schematic configuration of a thermal printer Z according to an embodiment.

As shown in FIG. 6, the thermal printer Z according to the embodiment includes the thermal head X1, a conveying mechanism 40, a platen roller 50, a power supply 60, and a control device 70. The thermal head X1 is attached to an attachment face 80*a* of an attachment member 80 disposed in a housing (not shown) of the thermal printer Z. Further, the thermal head X1 is attached to the attachment member 80 such that the heat generating portions 9 are arranged in a direction perpendicular to a conveyance direction S of a recording medium P, that is, a main scanning direction. Accordingly, in the thermal head X1, the first main face 7*c* side of the substrate 7 corresponds to an upstream side in the conveyance direction of the recording medium P, and the second main face 7*d* side of the substrate 7 corresponds to a downstream side in the conveyance direction of the recording medium P.

The conveying mechanism conveys 40 the recording medium P such as thermal paper, receiver paper, or a card, in the direction of an arrow S in FIG. 6 to convey the recording medium onto the heat generation portions 9 of the thermal head X1, and includes conveying rollers 43, 45, 47, and 49. The conveying rollers 43, 45, 47, and 49 may be formed by coating cylindrical shaft bodies 43*a*, 45*a*, 47*a*, and 49*a* made of metal such as stainless steel, with elastic members 43*b*, 45*b*, 47*b*, 49*b* made of butadiene rubber or the like. Here, though not shown, when the recording medium P is receiver paper or a card, an ink film is conveyed together with the recording medium P, between the recording medium P and the heat generating portions 9 of the thermal head X1.

The platen roller 50 has a function of pressing the recording medium P against the heat generating portions 9 of the thermal head X1. Further, the platen roller 50 is disposed to extend in the direction perpendicular to the conveyance direction S of the recording medium P, and both ends thereof are supported such that the recording medium P can be rotated while being pressed against the heat generating portions 9. The platen roller 50 may be formed by coating a cylindrical shaft body 50*a* made of metal such as stainless steel, with an elastic member 50*b* made of butadiene rubber or the like.

The power supply 60 has a function of supplying a voltage for making the heat generating portions 9 of the thermal head X1 generate heat, as described above, and a voltage for operating the driving ICs 11. The control device 70 has a function of supplying a control signal for controlling the operation of the driving ICs 11 to the driving ICs 11 in order to make the heat generating portions 9 of the thermal head X1 generate heat selectively, as described above.

The thermal printer Z according to the embodiment conveys the recording medium P onto the heat generating portions 9 of the thermal head X1 with the conveying mechanism 40 and selectively makes the heat generating portions 9 generate heat with the power supply 60 and the control device 70. Therefore, it is possible to perform predetermined printing on the recording medium P. Here, when the recording medium P is receiver paper or a card, it is possible to perform printing on the recording medium P by thermally transferring ink of the ink film (not shown) conveyed together with the recording medium P onto the recording medium P.

<Second Embodiment>

Figure 7:
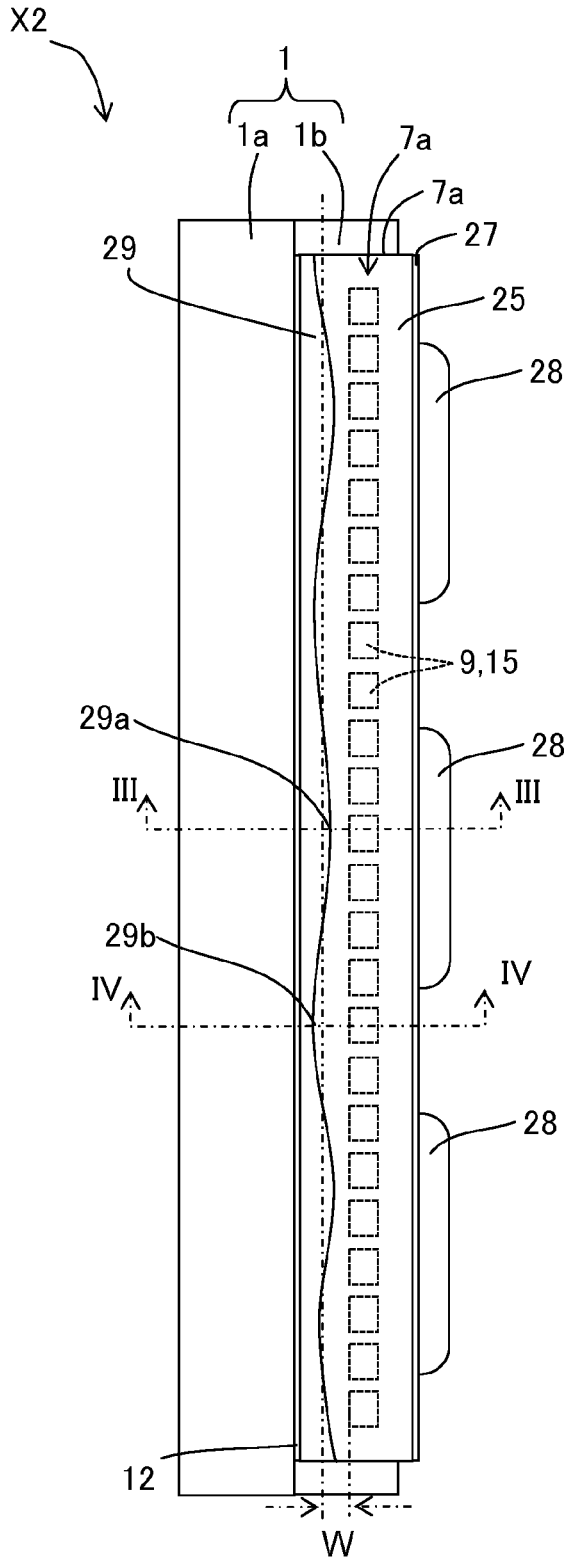
FIG. 7 is a left side view showing a thermal head according to a second embodiment of the invention.
Figure 8A:
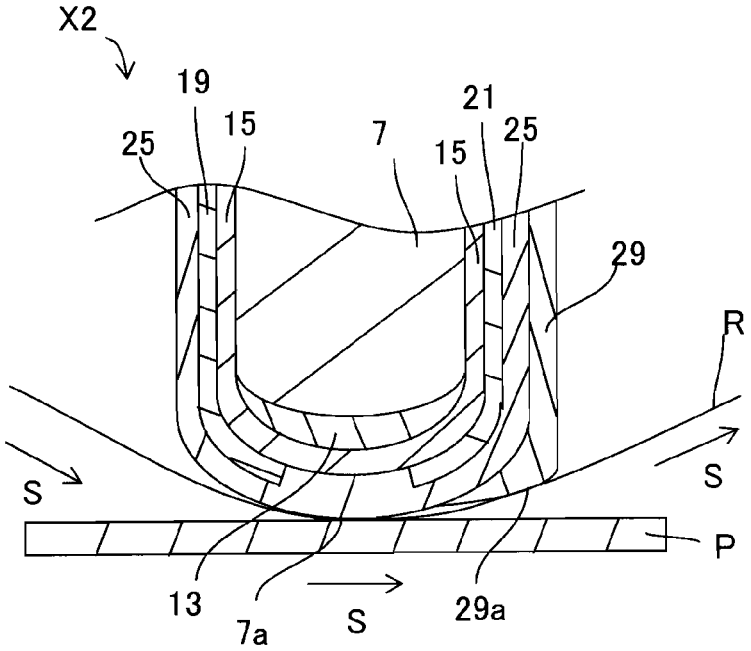
Figure 8B:
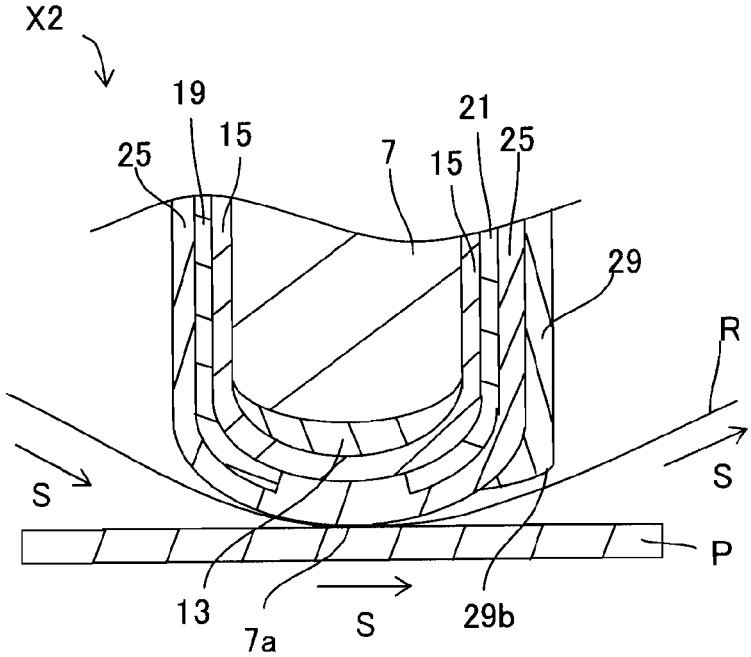

With reference to FIGS. 7 and 8A and 8B, a thermal head X2 according to a second embodiment is described. The second insulating layer 29 has concavities and convexities in its end on the heat accumulating layer 13 side from an end view. In other words, the second insulating layer 29 has a corrugated shape in its end on the heat accumulating layer 13 side from an end view. The other configurations of the thermal head X2 are the same as those of the thermal head X1, and accordingly description thereof are omitted.

The second insulating layer 29 constituting the thermal head X2 is configured so that the end on the heat accumulating layer 13 side has different distances to the heat generating portion 9 in the longitudinal direction of the substrate 7. Specifically, the second insulating layer 29*a* is located to be closer to the heat accumulating layer than the second insulating layer 29*b*. Further, as shown in FIGS. 8A and 8B, the second insulating layer 29*a* is located to be closer to the first end face 7*a* than the second insulating layer 29*b*.

In the case of making a print in a hard recording medium such as a card, a print is usually made by interposing an ink ribbon between the hard recording medium and a thermal head. In this manner, when the thermal head is driven at high speed in association with high speed printing, blurring may occur in the print in the case where detachability between the ink ribbon and the thermal head is bad or static electricity is generated in the hard recording medium.

On the other hand, the second insulating layer 29 of the thermal head X2 has the concavities and convexities in its end on the heat accumulating layer 13 side from an end view. Accordingly, it is possible to easily detach the ink ribbon R from the protective layer 25 and the second insulating layer 29 when the ink ribbon R is fed in contact with the protective layer 25 and the second insulating layer 29 on the heat generating portion 9 in making a print. In other words, as shown in FIG. 8B, when the ink ribbon R is fed from on the protective layer 25 to on the second insulating layer 29, the ink ribbon R comes into partly floating from the second insulating layer 29*b*, which is concavities. Consequently, even when the ink ribbon R is attracted and attached to the protective layer 25 and the second insulating layer 29 owing to static electricity etc., the ink ribbon R can be easily detached from the protective layer 25 and the second insulating layer 29.

Further, since the second insulating layer 29 has the corrugated shape in its end on the heat accumulating layer 13 side from an end view, the ink ribbon R comes into partly floating from the second insulating layer 29, as described above. Consequently, the ink ribbon R can be easily detached from the protective layer 25 and the second insulating layer 29. In addition, the corrugated shape from an end view means that a distance between the end of the second insulating layer 29 and the heat generating section 9 is not constant and the end of the second insulating layer 29 forms a continuous curve.

It is preferable that the corrugated shape, which is the shape of the end of the second insulating layer 29, is such that the end of the second insulating layer 29 is located at a distance of ±0.15 mm with respect to an average distance W, the average distance W being a distance between the end of the second insulating layer 29 and the end of the heat generating section 9 on the second insulating layer 29 side. Thereby, a detachment of the thermal head X2 from the ink ribbon R can be efficiently carried out. In addition, the corrugated shape is formed by appropriately adjusting a printing step in forming the second insulating layer 29 or viscosity of resin which forms the second insulating layer 29.

In addition, as an example of the second insulating layer having the concavities and convexities in its end from an end view is shown the example in which the end of the second insulating layer 29 forms the corrugated shape, however, the end of the second insulating layer 29 is not limited thereto. For example, the end of the second insulating layer 29 may be formed such that the end of the second insulating layer 29 gradually forms the concavities and convexities in a stepwise pattern.

Figure 9A:
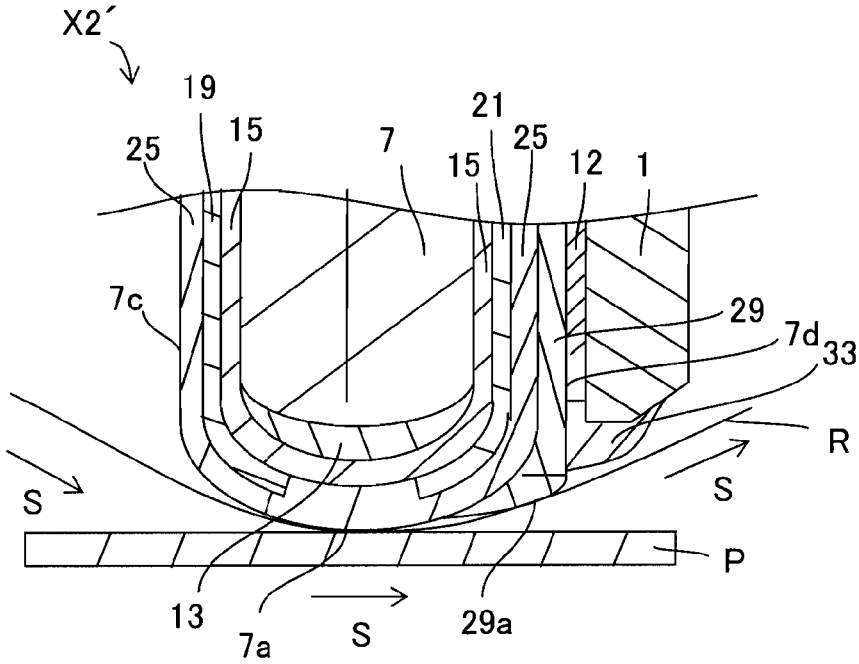
Figure 9B:
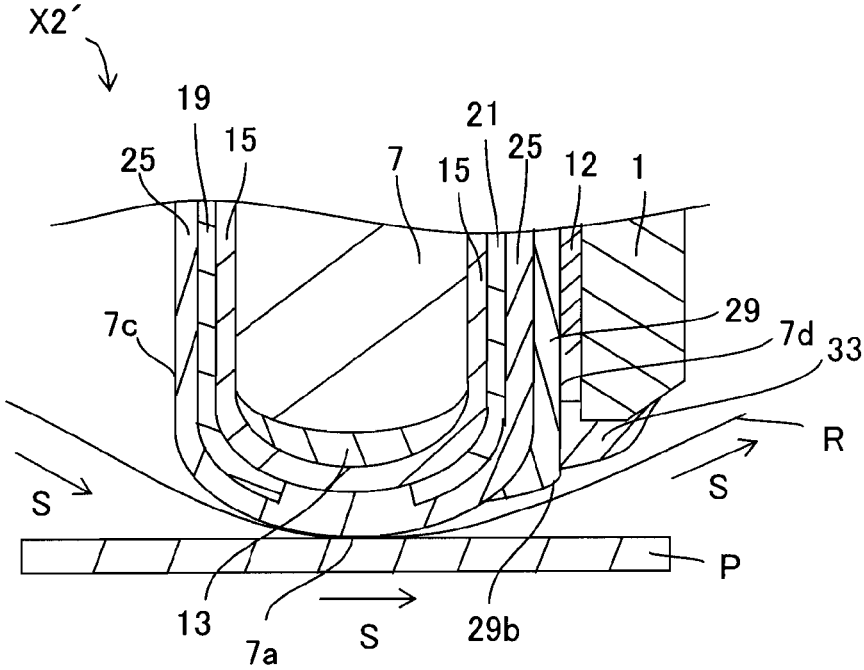

With reference to FIGS. 9A and 9B, a modified example of the thermal head X2 will be described. A thermal head X2' is different in configuration from the thermal head X2 in that a sealing member 33 is disposed between the heat dissipating body 1, the bonding layer 12 and the second insulating layer 29. The other configuration of the thermal head X2' is the same as those of the thermal head X2.

The thermal head X2' includes the sealing member 33 which is disposed between a heat dissipating body 1, a bonding layer 12 and a second insulating layer 29. The sealing member 33 is disposed from a top of the second insulating layer 29 to the heat dissipating body 1 and disposed so as to seal a space between the heat dissipating body 1, the bonding layer 12 and the second insulating layer 29. Accordingly, a possibility that paper scraps, dust or the like enter between the heat dissipating body 1, the bonding layer 12 and the second insulating layer 29 can be reduced.

The sealing member 33, as well as the first insulating layer 27, can be formed of, for example, a resin material, such as epoxy resin or polyamide resin. Further, the sealing member 33 can be formed by using, for example, a thick-film formation technique such as screen printing. In view of prevention of entering of paper scraps, dust or the like, it is preferable that the sealing member is disposed from one end of the substrate 7 to the other end thereof in the longitudinal direction of the substrate 7.

It is preferable that the sealing member 33 is disposed so as not to protrude from the protective layer 25 formed on the heat generating portions 9. In other words, it is preferable that the sealing member 33 is located to be closer to the second end face 7*b* than the protective layer 25 formed on the heat generating portions 9. Thereby, it is possible to reduce a possibility that the sealing member 33 contacts with the recording medium, the ink ribbon R or the like.

Further, it is possible to transfer the heat accumulated in the heat accumulating layer 13 through the second insulating layer 29 and the sealing member 33 by forming the sealing member 33 of a material having heat conductivity, and it is possible to efficiently transfer the heat of the heat accumulating layer 13 to the heat dissipating body 1.

In addition, it is exemplified in FIGS. 9A and 9B that the sealing member 33 of the thermal head X2' is disposed between the heat dissipating body 1 and the second insulating layer 29 and is not disposed to extend to a vicinity of the bonding layer 12. However, the sealing member 33 may be disposed to extend to the vicinity of the bonding layer 12. In other words, the space between the heat dissipating body 1, the bonding layer 12 and the second insulating layer 29 may be filled with the sealing member 33.

<Third Embodiment>

With reference to FIGS. 10A, 10B, 11A and 11B, a thermal head X3 according to a third embodiment of the invention will be described. The thermal head X3 is different in configuration from the thermal head X1 in that the second insulating layer 29 is disposed from the second main face 7*d* to the heat accumulating layer 13, as well as from the first main face 7*c* to the heat accumulating layer 13 of the first end face 7*a*. In other respects, the thermal head X3 is the same as the thermal head X1, and thus, description thereof will be omitted.

Figure 10A:
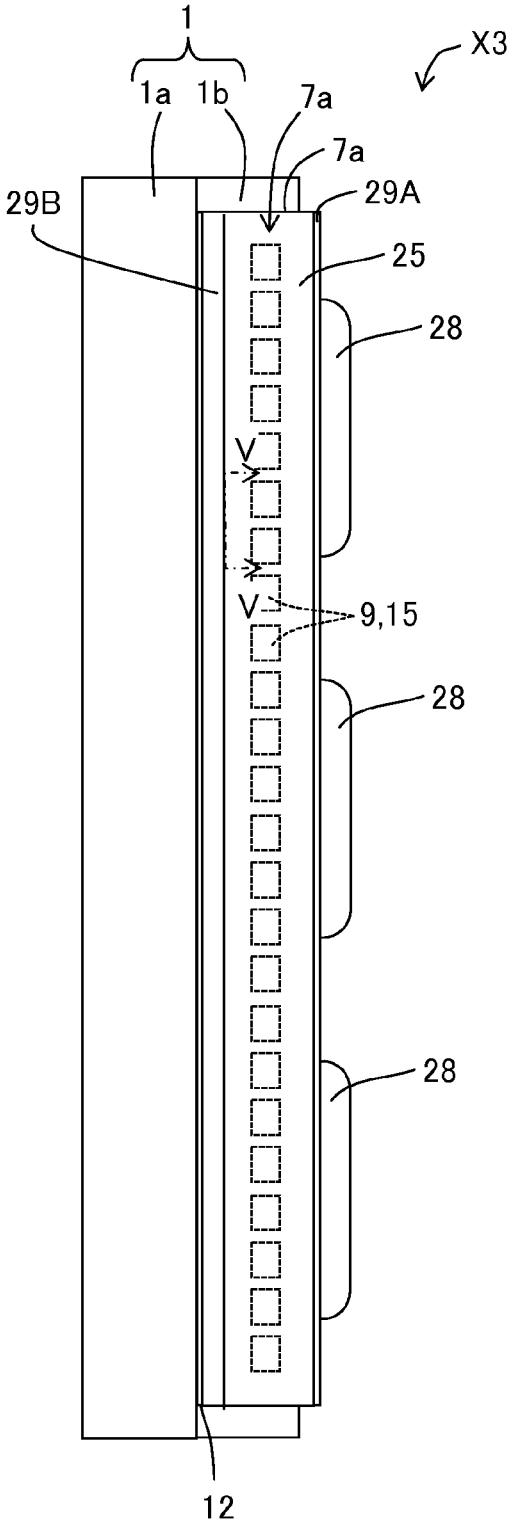
FIG. 10A is a left side view showing a thermal head according to a third embodiment of the invention.

As shown in FIG. 10A, in the thermal head X3, the second insulating layer 29 has a second insulating layer 29A on the first main face 7*c* side, disposed from the first main face 7*c* to the heat accumulating layer 13, and a second insulating layer 29B on a side of the second main face 7*d*, disposed from the second main face 7*d* to the heat accumulating layer 13. Therefore, a region of the protective layer 25 on the first main face 7*c* side is covered with the second insulating layer 29A. Due to the presence of the second insulating layer 29A, heat of the heat accumulating layer 13 can be transferred to the second insulating layer 29A by way of the protective layer 25. Since the second insulating layer 29A is disposed from the first main face 7*c* to the heat accumulating layer 13, the heat of the heat accumulating layer 13 can be transferred to the first main face 7*c* side, whereby the heat of the heat accumulating layer 13 can be dissipated.

That is, in the thermal head X3, the second insulating layer 29A is provided in addition to the second insulating layer 29B, so that it is possible to transfer the heat of the heat accumulating layer 13 to the second main face 7*d* side as well as to the first main face 7*c* side. Therefore, in the thermal head X3, a larger amount of heat of the heat accumulating layer 13 can be dissipated.

Further, in the thermal head X3, the second insulating layer 29B disposed on the second main face 7*d* side is located to be closer to the heat accumulating layer 13 than the second insulating layer 29A disposed on the first main face 7*c* side. That is, the thermal head X3 is configured such that distances between the second insulating layer 29B on the second main face 7*d* side and the heat generating portions 9 are smaller than distances between the second insulating layer 29A on the first main face 7*c* side and the heat generating portions 9. Therefore, it is possible to transfer the heat of the heat accumulating layer 13 to the heat dissipating body 1 efficiently, by way the second insulating layer 29B which is connected to the heat dissipating body 1 through the bonding layer 12.

Figure 10B:
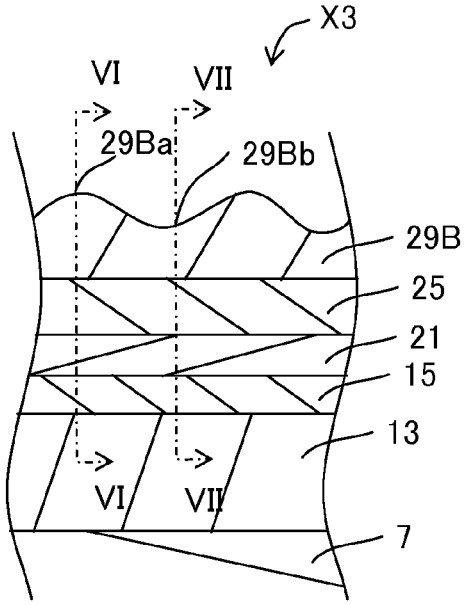
FIG. 10B is a cross-sectional view taken along the line V-V of the thermal head shown in FIG. 10A.
Figure 11A:
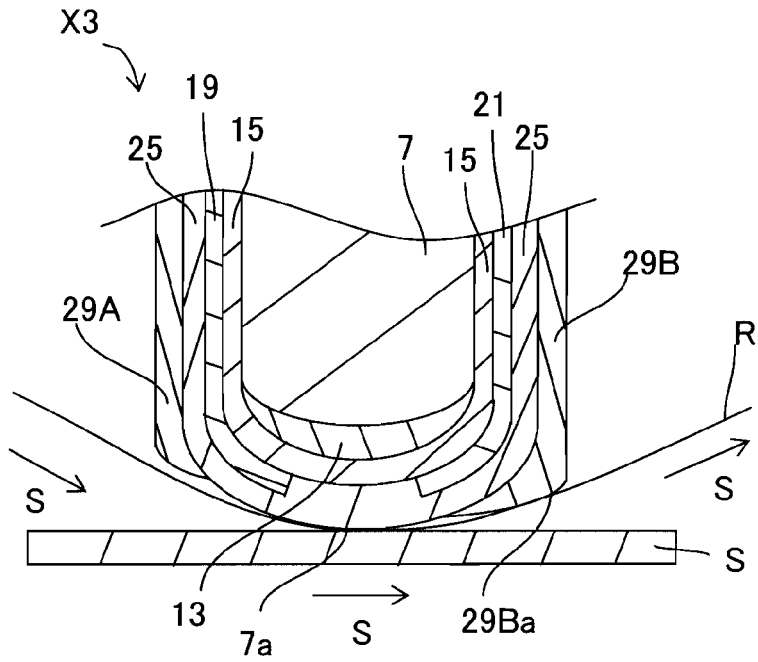
Figure 11B:
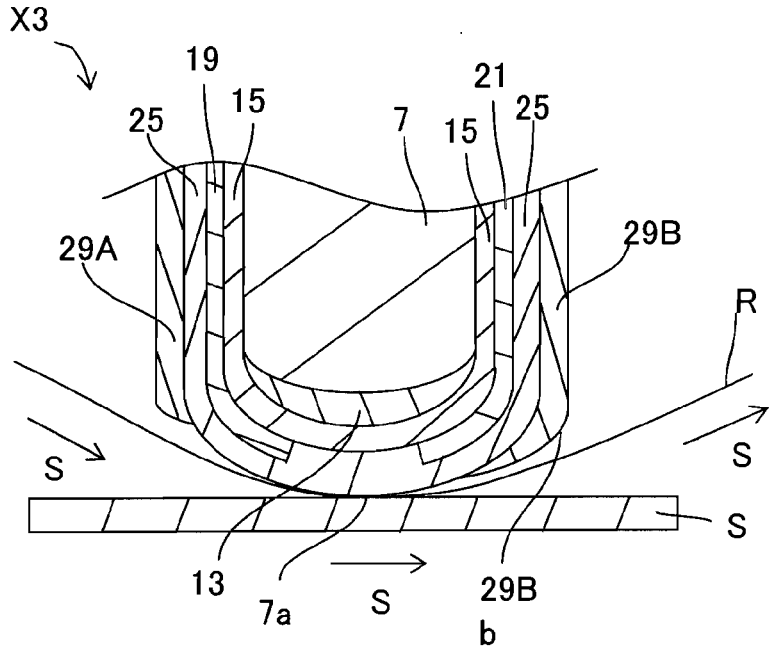

Moreover, in the thermal head X3, as shown in FIG. 10B, the end of the second insulating layer 29B disposed on the second main face 7*d* side is provided with concavities and convexities in a surface thereof. In other words, the thermal head X3 is configured such that a thickness of the second insulating layer 29B varies in a longitudinal direction of the substrate 7. Specifically, the thickness of a second insulating layer 29Ba is larger than the thickness of a second insulating layer 29Bb. Since, the longitudinal direction of the substrate 7 coincides with the main scanning direction, the thermal head X3 is so configured that the end of the second insulating layer 29B has the concavities and convexities in the main scanning direction.

Since the surface of the end of the second insulating layer 29B has the concavities and convexities in the main scanning direction, as shown in FIGS. 10A and 10B, the thicker second insulating layer 29Ba on the second main face 7*d* side, is brought into contact with the ink ribbon R, but the thinner second insulating layer 29Bb on the first main face 7*c* side, is not brought into contact with the ink ribbon R. Accordingly, the second insulating layer 29B has portions which do not contact the ink ribbon R, so that it is easy to detach the ink ribbon R and the second insulating layer 29 from each other.

Further, since the distances between the second insulating layer 29B on the second main face 7*d* side and the heat generating portions 9 are smaller than the distances between the second insulating layer 29A on the first main face 7*c* side and the heat generating portions 9, the second insulating layer 29B functions, on the second main face 7*d* side where adherence tends to occur due to the contact with the ink ribbon R, as a guide member to facilitate detachment. Therefore, it is easy to detach the ink ribbon R and the second insulating layer 29 from each other.

The concavities and convexities provided on the surface of the second protective layer 29B of the second main face 7*d* can be formed by polishing. Also, the concavities and convexities can be provided by forming a resin into a convex-concave shape in advance and then bonding it. Note that a difference in height between the concavities and convexities is preferably 5 μm to 20 μm.

Here, though only the second insulating layer 29B on the second main face 7*d* side is provided with the concavities and convexities in the longitudinal direction of the substrate 7, the second insulating layer 29A on the first main face 7*c* side may also be provided with the concavities and convexities. Moreover, the distances between the second insulating layer 29B on the second main face 7*d* side and the heat generating portions 9 may be set equal to the distances between the second insulating layer 29A on the first main face 7*c* side and the heat generating portions 9.

Further, though it is exemplified that the second insulating layer 29 is provided with the concavities and convexities in the longitudinal direction of the substrate 7, the second insulating layer 29 may be provided with only the concavities in the longitudinal direction of the substrate 7. Also in this case, portions that do not contact with the ribbon R can be created in part of the second insulating layer 29 in the main scanning direction, whereby detachability between the ink ribbon R and the thermal head X3 can be enhanced.

Although an embodiment of the invention was described above, the invention is not limited to the embodiment and may be modified without departing from the spirit of the invention. For example, although the thermal printer Z using the thermal head X1 according to the first embodiment is shown, the thermal printer is not limited thereto. The thermal heads X2, X2' and X3 may be used for the thermal printer Z. Further, the thermal heads X1 to X3 may be appropriately combined.

For example, in combination of the thermal heads X2 and X3, such a configuration that the second insulating layer 29 has a corrugated shape from an end view and the concavities and convexities are provided in the longitudinal direction of the substrate 7 may be provided. Also in this case, detachability between the ink ribbon R and the second insulating layer 29 can be increased.

Further, in the thermal head X1, as shown in FIGS. 3 and 4, the second insulating layer 29 is formed on the protective layer 25 formed on the second main face 7*d* of the substrate 7. Further, the second insulating layer 29 is formed to so as cover the region of the common electrodes 17 at the right side from the protective layer 25 on the second main face 7*d* of the substrate 7. However, in the thermal head X1, as long as the second insulating layer 29 is formed at least on the protective layer 25 on the second main face 7*d* of the substrate 7, the invention is not limited thereto. For example, though not shown, the region of the common electrodes 17 which is covered with the second insulating layer 29 in FIGS. 3 and 4, may be covered with the protective layer 25, and the second insulating layer 29 may be formed on the protective layer 25. In the thermal head X1, although the common electrodes 17 extend from the first end face 7*a* of the substrate 7 to the first main face 7*c* of the substrate 7 through the second main face 7*d* of the substrate 7 and the second end face 7*b* of the substrate 7, the invention is not limited thereto. For example, the common electrodes 17 may be formed only on the first end face 7*a* and the second main face 7*d* of the substrate 7. In this case, the common electrodes 17 and the print wires 5*b* of the FPC 5 formed on the second main face 7*d* of the substrate 7 may be connected by a separate jumper wire.

Further, in the thermal head X1, although the common electrodes 17 and the IC-FPC connection electrodes 21 disposed on the substrate 7 of the head base substrate 3 are electrically connected to the external power supply and the control device through the FPC 5, the invention is not limited thereto. For example, various wires on the head base substrate 3 may be electrically connected to the external power supply and the like through, not a flexible printed circuit board having flexibility, like the FPC 5, but a hard printed circuit board. In this case, for example, the common electrodes 17 and the IC-FPC connection electrodes 21 of the head base substrate 3 and print wires of a printed circuit board may be connected by wire bonding, ACF connection, solder connection or the like.

Further, in the thermal head X1, as shown in FIGS. 3 and 4, although the electric-resistive layer 15 is formed not only on the heat accumulating layer 13, but on the first main face 7*c* and second main face 7*d* of the substrate 7, as long as it is connected with lead portions 17*c* and the individual electrodes 19 on the first end face 7*a* of the substrate 7, the invention is not limited thereto. For example, the electric-resistive layer 15 may be formed only on the heat accumulating layer 13. Further, the common electrodes 17 and the individual electrodes 19 on the first end face 7*a* of the substrate 7 may be formed directly onto the heat accumulating layer 13 and the electric-resistive layer 15 may be disposed only in the region between the front ends of the common electrodes 17 and the front ends of the individual electrodes 19 on the heat accumulating layer 13.

Figure 12:
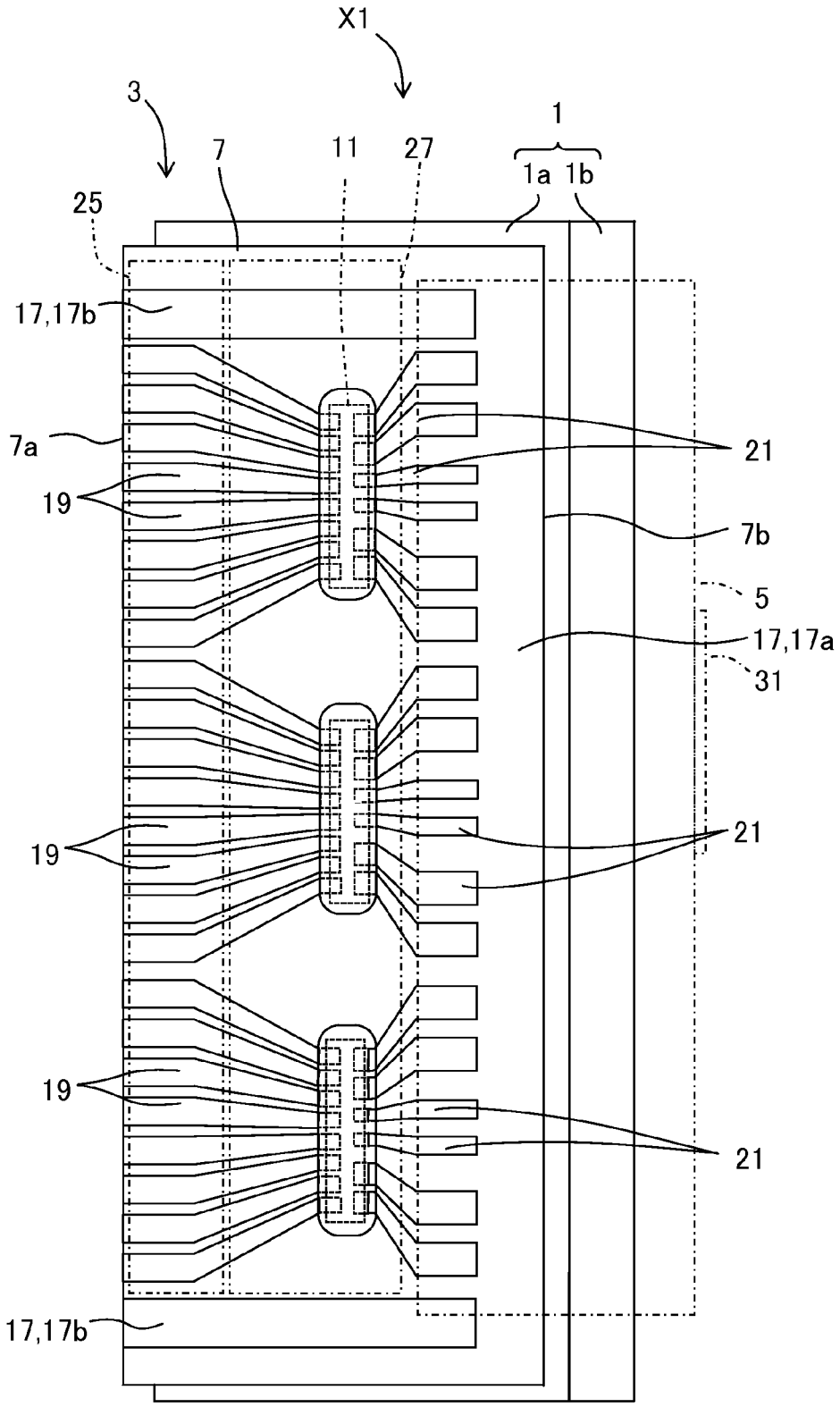
FIG. 12 is a left side view showing a modified example of the thermal head shown in FIG. 1.
Figure 13:
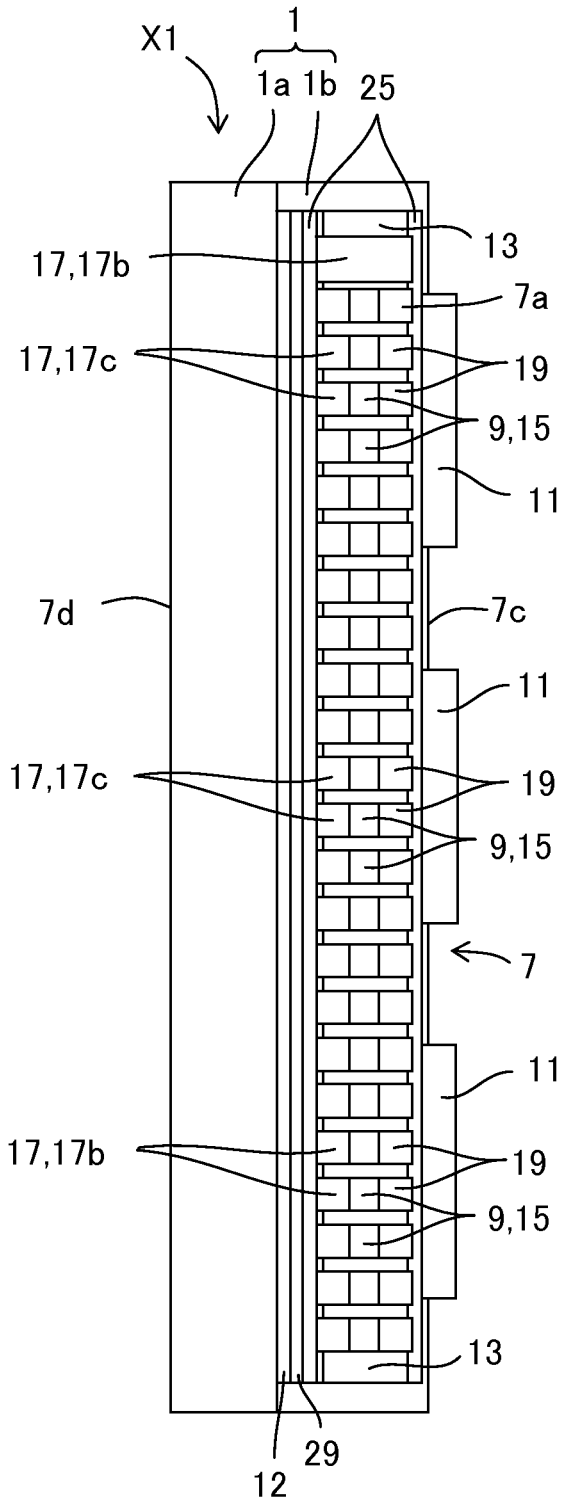
FIG. 13 is a left side view showing a modified example of the thermal head shown in FIGS. 2A and 2B.

Further, in the thermal head X1, although the common electrodes 17 extend to the first main face 7*c* of the substrate 7, through the second main face 7*d* of the substrate 7 and the second end face 7*b* of the substrate 7, from the first end face 7*a* of the substrate 7, the invention is not limited thereto. For example, the common electrodes 17 may extend to the second main face 7*d* of the substrate 7 from the first end face 7*a* of the substrate 7 and extend to the first main face 7*c* of the substrate 7 through the first end face 7*a* of the substrate 7 to return on the second main face 7*d* of the substrate 7. In detail, as shown in FIGS. 12 and 13, in the common electrodes 17, one end of each lead portion 17*c* is connected to the heat generating portion 9 on the first end face 7*a* of the substrate 7. The other end of each lead portion 17*c* extends to the second main face 7*d* of the substrate 7. The lead portions 17*c* are connected to the main wire portions (not shown) formed throughout the second main face 7*d* of the substrate 7, on the second main face 7*d* of the substrate 7. Further, sub-wire portions 17*b* extend to the first main face 7*c* of the substrate 7 through the first end face 7*a* of the substrate 7 from the main wire portions of the second main face 7*d* of the substrate 7. The sub-wire portion 17*b* extends in a strip shape around the ends of both sides in the longitudinal direction of the substrate 7. In the common electrodes 17 formed as described above, the ends of the sub-wire portions 17*b* are connected to the FPC 5, on the firs main face 7*c* of the substrate 7, as shown in FIG. 12.

Figure 14:
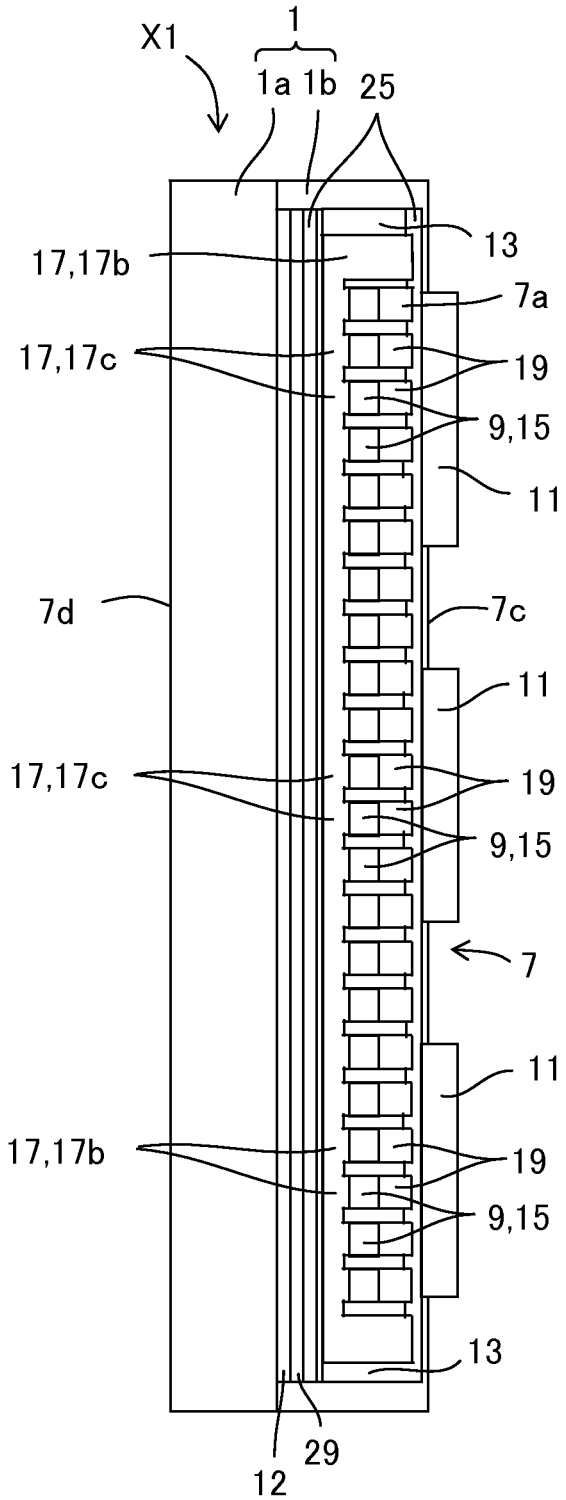
FIG. 14 is a left side view showing a modified example of the thermal head shown in FIG. 13.

Further, in the thermal head X1 shown in FIGS. 12 and 13, although the lead portions 17*c* of the common electrodes 17 are formed from the first end face 7*a* of the substrate 7 to the second main face 7*d* of the substrate 7 and connected to the main wire portions (not shown) on the second main face 7*d* of the substrate 7, the invention is not limited thereto. For example, as shown in FIG. 14, the lead portions 17*c* may be formed only on the first end face 7*a* of the substrate 7, the main wire portions 17*a* may be formed only on the first end face 7*a* of the substrate 7 in the arrangement direction of the heat generating portions 9, and the lead portions 17*c* may be connected to the main wire portions 17*a*. In this case, as shown in FIG. 14, the sub-wire portions 17*b* are connected both ends of the main wire portions 17*a*.

Figure 15:
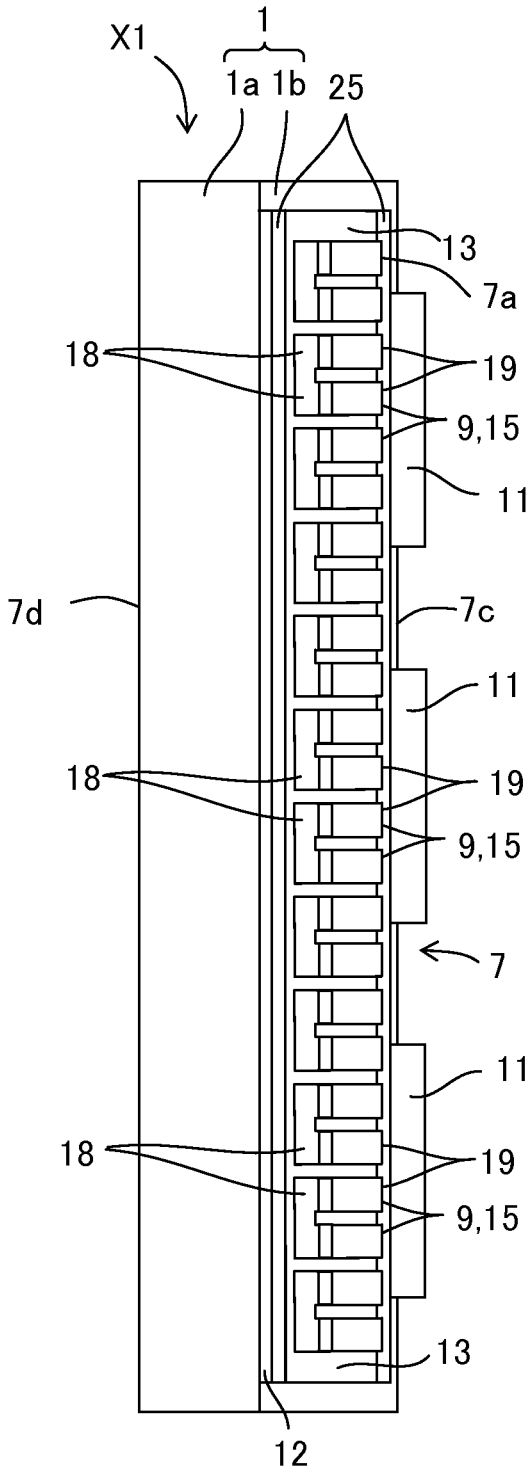
FIG. 15 is a left side view showing a modified example of the thermal head shown in FIG. 14.

Further, in the thermal head X1 shown in FIG. 14, although all of the plurality of heat generating portions 9 are connected to the common electrodes 17 in common, the invention is not limited thereto. For example, as shown in FIG. 15, instead of the common electrodes 17, a plurality of heat generating portions 9 may be connected to two adjacent heat generating portions 9 by heat generating portion connection wires 18 that connect the heat generating portions 9. In this case, thought not described in detail, it is possible to make the heat generating portions 9 generate heat, by modifying the configuration of the driving ICs or various wires such that a voltage is applied to between two individual electrodes 19 connected to two adjacent heat generating portions 9 connected to the heat generating portion connection wires 18.

Here, in the thermal head shown in FIG. 3, although the protective layer 25 covers the common electrodes 17 formed on the heat accumulating layer 13 and the second main face 7*d* of the substrate 7, the invention is not limited thereto, as long as the protective layer 25 is formed to extend from the first end face 7*a* of the substrate 7 to the second main face 7*d* of the substrate 7 and covers at least the heat generating portions 9 and the common electrodes 17 on the first end face 7*a*. For example, as in the thermal head X1 shown in FIGS. 14 and 15, the common electrodes 17 may not be formed on the second main face 7*d* of the substrate 7. In this case, though not shown in FIGS. 13 and 14, the protective layer 25 is formed to extend from the first end face 7*a* of the substrate 7 to the second main face 7*d* of the substrate 7 and from the first end face 7*a* of the substrate 7 to the first main face 7*c* of the substrate 7.

Further, in the thermal head X1 of the embodiment described above, although the heat generating portions 9 are disposed at substantially the center in the thickness direction of the substrate 7 on the heat accumulating layer 13, the invention is not limited thereto, as long as it is possible to form the second region of the heat accumulating layer 13 where the heat generating portions 9 are not disposed, closer to the second main face 7*d* of the substrate 7 than the first region of the heat accumulating layer 13. For example, the heat generating portions 9 may disposed at a position deviating to the first main face 7*c* side of the substrate 7 from substantially the center in the thickness direction of the substrate 7, on the heat accumulating layer 13.

Further, in the thermal head X1 of the embodiment described above, as shown in FIGS. 3 and 4, although the first end face 7*a* of the substrate 7 has a protruding curved shape, the surface shape and the inclination angle of the first end face 7*a* of the substrate 7 are not specifically limited, and may be implemented in an arbitrary form. For example, the first end face 7*a* of the substrate 7 may be a flat surface, or may be a bent surface. Further, the angle formed by the first main face 7*c* and the second main face 7*d* of the substrate 7, and the first end face 7*a* of the substrate 7 may be an obtuse angle or an acute angle, not a right angle.

Furthermore, although it is exemplified that the heat generating portions 9 are disposed on the first end face 7*a* of the substrate 7, the invention is not limited thereto. Even in a flat head in which the heat generating portions 9 are disposed on the first main face 7*c*, the invention can be applied.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A thermal head, comprising:

a substrate;

a heat accumulating layer disposed on part of the substrate;

a heat generating portion disposed on the heat accumulating layer;

an electrode electrically connected to the heat generating portion;

a protective layer that covers the heat generating layer and part of the electrode; and an insulating layer having thermal conductivity, the insulating layer covering part of a region of the electrode which region is not covered with the protective layer, the insulating layer covering part of the protective layer and extending over the heat accumulating layer.

2. The thermal head according to claim 1, wherein the substrate has a rectangular shape in a plan view, the substrate has a first main face, a second main face disposed opposite to the first main face, and an end face disposed adjacent to the first main face and the second main face, the heat accumulating layer is disposed on the end face, and the insulating layer extends from the second main face to the heat accumulating layer around the heat generating portion located on the end face.

3. The thermal head according to claim 2, further comprising a heat dissipating body, wherein the heat dissipating body is connected to the substrate through the insulating layer.

4. The thermal head according to claim 2, wherein the insulating layer extends from the first main face to the heat accumulating layer around the heat generating portion located on the end face.

5. The thermal head according to claim 3, wherein the insulating layer extends from the first main face to the heat accumulating layer around the heat generating portion located on the end face.

6. The thermal head according to claim 4, wherein the second main face is located downstream in a conveyance direction of a recording medium, and part of the insulating layer disposed on the second main face is located to be closer to the end face than part of the insulating layer disposed on the first main face.

7. The thermal head according to claim 1, wherein a surface of the insulating layer has concavities and convexities in its end on the heat accumulating layer side.

8. The thermal head according to claim 1, wherein the insulating layer has concavities and convexities in its end on the heat accumulating layer side from an end view.

9. The thermal head according to claim 7, wherein the insulating layer has a corrugated shape in its end on the heat accumulating layer side from an end view.

10. The thermal head according to claim 2, wherein the insulating layer has concavities and convexities in its end on the heat accumulating layer side from an end view.

11. The thermal head according to claim 10, wherein the insulating layer has a corrugated shape in its end on the heat accumulating layer side from an end view.

12. The thermal head according to claim 5, wherein the insulating layer has concavities and convexities in its end on the heat accumulating layer side from an end view.

13. The thermal head according to claim 12, wherein the insulating layer has a corrugated shape in its end on the heat accumulating layer side from an end view.

14. A thermal printer, comprising:

the thermal head according to claim 1;

a conveying mechanism that conveys a recording medium onto the heat generating portion; and a platen roller that presses the recording medium against the heat generating portion.

15. A thermal printer, comprising:

the thermal head according to claim 2;

a conveying mechanism that conveys a recording medium onto the heat generating portion; and a platen roller that presses the recording medium against the heat generating portion.

* * * * *

UNITED STATES PATENT AND TRADEMARK OFFICE

CERTIFICATE OF CORRECTION

PATENT NO. : 8,619,106 B2
APPLICATION NO. : 13/404463
DATED : December 31, 2013
INVENTOR(S) : Inokuma et al.

It is certified that error appears in the above-identified patent and that said Letters Patent is hereby corrected as shown below:

IN THE SPECIFICATION

Column 3, lines 35-40, delete "Thus, the face of the heat accumulating layer 13 is curved. The heat accumulating layer 13 having the curved face functions to appropriately press a recording medium to be printed, against a protective layer 25 formed on the heat generating portions 9, which is described below." and insert therefor --Thus, the face of the heat accumulating layer 13 is curved. The heat accumulating layer 13 having the curved face functions to appropriately press a recording medium to be printed, against a protective layer 25 formed on the heat generating portions 9, which is described below.--.
Column 4, line 8, delete "of exposed".
Column 4, line 33, delete "dot" and insert therefor --dots--.
Column 4, line 66, delete "Ics" and insert therefor --ICs--.
Column 6, line 27, delete "kwon" and insert therefor --known--.
Column 7, line 27, delete "polyimide" and insert therefor --polyamide--.
Column 8, line 9, delete "polyimide" and insert therefor --polyamide--.
Column 8, line 54, after "transferred", insert --to--.
Column 9, line 43, after "located", insert --on--.
Column 11, line 56, delete "to the driving ICs 11".
Column 12, line 41, delete "is" and insert therefor --has--.
Column 12, line 48, delete "into" and insert therefor --in--.
Column 14, line 37, after "way", insert therefor --of--.
Column 15, line 49, delete "to so as" and insert therefor --so as to--.
Column 16, line 56, delete "firs" and insert therefor --first--.
Column 17, line 11, delete "thought" and insert therefor --though--.
Column 17, line 43, after the "may", insert --be--.

Signed and Sealed this
Twenty-ninth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,619,106 B2
APPLICATION NO. : 13/404463
DATED : December 31, 2013
INVENTOR(S) : Yoshihiro Inokuma et al.

It is certified that error appears in the above-identified patent and that said Letters Patent is hereby corrected as shown below:

In the Specification

Column 7, line 27 and Column 8, line 9,
"polyamide" (as corrected to read in Certificate of Correction issued July 29, 2014) is deleted, text is reinstated so that patent is returned to its original state to read:

--polyimide--.

Column 13, line 30,
Delete "polyamide" and insert therefor --polyimide--.

Signed and Sealed this
Second Day of September, 2014

Michelle K. Lee

Michelle K. Lee
*Deputy Director of the United States Patent and Trademark Office*